US009732754B2

(12) United States Patent
Huang et al.

(10) Patent No.: US 9,732,754 B2
(45) **Date of Patent: *Aug. 15, 2017**

(54) SHUNT PULSATION TRAP FOR POSITIVE-DISPLACEMENT MACHINERY

(71) Applicant: HI-BAR BLOWERS, INC., Fayetteville, GA (US)

(72) Inventors: Paul Xiubao Huang, Fayetteville, GA (US); Sean William Yonkers, Peachtree City, GA (US)

(73) Assignee: HI-BAR BLOWERS, INC., Fayetteville, GA (US)

( * ) Notice: Subject to any disclaimer, the term of this patent is extended or adjusted under 35 U.S.C. 154(b) by 4 days.

This patent is subject to a terminal disclaimer.

(21) Appl. No.: 14/836,194

(22) Filed: Aug. 26, 2015

(65) Prior Publication Data

US 2015/0361982 A1 Dec. 17, 2015

Related U.S. Application Data

(63) Continuation-in-part of application No. 14/285,678, filed on May 23, 2014, now Pat. No. 9,551,342, and
(Continued)

(51) Int. Cl.
*F04C 29/00* (2006.01)
*F04C 29/06* (2006.01)
(Continued)

(52) U.S. Cl.
CPC ..... *F04C 29/0035* (2013.01); *F04B 11/00* (2013.01); *F04B 39/0027* (2013.01);
(Continued)

(58) Field of Classification Search
CPC .. F04C 29/0035; F04C 29/065; F04C 29/061; F04C 29/068; F04B 11/00;
(Continued)

(56) References Cited

U.S. PATENT DOCUMENTS 2,489,887 A 11/1949 Houghton
4,215,977 A 8/1980 Weatherston
(Continued)

FOREIGN PATENT DOCUMENTS

JP 60252117 12/1985
JP 01032085 2/1989
(Continued)

*Primary Examiner* — Mark Laurenzi
*Assistant Examiner* — Wesley Harris
(74) *Attorney, Agent, or Firm* — Gardner Groff Greenwald & Villanueva, P.C.

(57) ABSTRACT

A shunt pulsation trap for a positive-displacement gas-transfer machine having a gas transfer chamber with an intake port and a discharge port and having at least one positive-displacement drive device (such as two cooperating rotors) defining a compression region of the transfer chamber. The trap includes a pulsation-trap chamber arranged for parallel fluid flow with the machine transfer chamber. The trap has a first (e.g., inlet) port in communication with the compression region of the transfer chamber (e.g., at least one lobe span away or totally isolated from the transfer-chamber intake port), a second (e.g., discharge) port in communication with the discharge port of the transfer chamber, and at least one pulsation dampener in the pulsation-trap chamber. In this way, the shunt pulsation trap traps and attenuates gas pulsations before discharge from the machinery transfer chamber, thereby reducing induced NVH and improving machinery efficiency.

21 Claims, 15 Drawing Sheets

Related U.S. Application Data a continuation-in-part of application No. 13/621,202, filed on Sep. 15, 2012, now Pat. No. 9,243,557, and a continuation-in-part of application No. 13/404,022, filed on Feb. 24, 2012, now Pat. No. 9,140,261, and a continuation-in-part of application No. 13/340,592, filed on Dec. 29, 2011, now Pat. No. 9,151,292, and a continuation-in-part of application No. 13/155,123, filed on Jun. 7, 2011, now Pat. No. 9,140,260.

(51) Int. Cl.

| | |
|---|---|
| ***F04B 11/00*** | (2006.01) |
| ***F04B 39/00*** | (2006.01) |
| ***F04C 18/12*** | (2006.01) |
| ***F04C 18/02*** | (2006.01) |

(52) U.S. Cl.

CPC ..... *F04B 39/0055* (2013.01); *F04B 39/0061* (2013.01); *F04B 39/0088* (2013.01); *F04C 18/126* (2013.01); *F04C 29/061* (2013.01); *F04C 29/065* (2013.01); *F04C 29/068* (2013.01); *F04C 18/0215* (2013.01)

(58) Field of Classification Search

CPC ..... F04B 39/0055; F04B 39/0061; F04B 39/0027; F04B 39/0088

See application file for complete search history.

(56) References Cited

U.S. PATENT DOCUMENTS

| | | | | |
|---|---|---|---|---|
| 4,558,566 | A | 12/1985 | Shirakura | |
| 4,984,974 | A | 1/1991 | Naya et al. | |
| 5,051,077 | A | 9/1991 | Yanagisawa et al. | |
| 5,217,817 | A | 6/1993 | Verspui et al. | |
| 5,370,512 | A | 12/1994 | Fujitani et al. | |
| 5,975,035 | A | 11/1999 | McWhorter | |
| 6,331,103 | B1 | 12/2001 | Teraoka | |
| 6,874,486 | B2 | 4/2005 | Prior et al. | |
| 8,172,039 | B2 | 5/2012 | Park et al. | |
| 9,140,260 | B2 * | 9/2015 | Huang | F04C 18/086 |
| 9,140,261 | B2 | 9/2015 | Huang et al. | |
| 9,151,292 | B2 * | 10/2015 | Huang | F04C 18/086 |
| 2002/0033302 | A1 | 3/2002 | Kaneko et al. | |
| 2006/0243520 | A1 | 11/2006 | Hertenstein et al. | |
| 2008/0168961 | A1 | 7/2008 | Prior et al. | |
| 2010/0269797 | A1 | 10/2010 | Prior | |
| 2012/0020824 | A1 | 1/2012 | Huang et al. | |
| 2012/0297818 | A1 | 11/2012 | Toyama et al. | |
| 2013/0247849 | A1 | 9/2013 | Huang et al. | |

FOREIGN PATENT DOCUMENTS

| | | |
|---|---|---|
| JP | 03124986 | 5/1991 |
| JP | 07332273 | 12/1995 |

* cited by examiner

SHUNT PULSATION TRAP FOR POSITIVE-DISPLACEMENT MACHINERY

CROSS-REFERENCE TO RELATED APPLICATIONS

This application is a continuation-in-part of U.S. Non-Provisional patent application Ser. No. 14/285,678, filed May 23, 2014, U.S. Non-Provisional patent application Ser. No. 13/621,202, filed Sep. 15, 2012, U.S. Non-Provisional patent application Ser. No. 13/404,022, filed Feb. 24, 2012, U.S. Non-Provisional patent application Ser. No. 13/340,592, filed Dec. 29, 2011, and U.S. Non-Provisional patent application Ser. No. 13/155,123, filed Jun. 7, 2011, all of which are hereby incorporated herein by reference in their entireties for all purposes.

TECHNICAL FIELD

The present invention relates generally to the field of positive-displacement machinery, and more specifically relates to pulsation dampeners for positive-displacement gas-transfer machinery.

BACKGROUND

Positive displacement (PD) type gas-transfer machinery can be grouped into two categories, compressors and expanders, as shown in FIG. 1*a*. PD type compressors convert shaft energy into gas internal energy by trapping a fixed amount of gas into a cavity, then transferring, compressing and discharging it into the outlet pipe. On the other hand, PD type expanders convert gas internal energy back to shaft energy by an opposite cycle of the compressor. In a broad sense, the gas media includes different gases or liquid vapor or mixture of gases and/or liquid. The following description will be focused on compressor for gas, but the problems involved and the principle and methods of improvement are the same for expander and for other types of gas media in general. As used herein, the term "gas" is intended to be broadly construed to mean "fluid", and as such means "gas, liquid, or gas/liquid mixtures."

Compared with dynamic type compressors, PD compressors are capable of generating a wide range of pressures and flows and are suited for various applications because of the many different types that have been developed over the years. For example, positive displacement compressors can be further classified according to the mechanism used to move the gas, including rotary type (such as Roots (lobe), screw, and scroll) and reciprocating type (such as piston and diaphragm), as further shown in FIG. 1*a*. Though each type of PD compressor has its own unique shape, movement, operating principle and pros and cons, they all have in common a flow suction port, a volume-trapping cavity (aka gas transfer chamber) and a flow discharge port where a valve controls the timing of the release of gas media. Moreover, they are all cyclic in nature and possess the same compression cycle for the transferred gas, that is, suction, trap, compression, discharge and dampening.

FIG. 2*a* shows two flow charts of a compression cycle (top figure is under-compression, bottom figure is over-compression) for a generic conventional positive displacement compressor and FIGS. 2*b*-2*e* show examples of the compression cycle and structure for the common PD types of Roots, screw, scroll and reciprocating, respectively. Gas flows from the suction port into the compressor cavity where the gas media gets trapped after closing of the compressor inlet port and is then transferred and compressed (where the trapped cavity volume is reduced). After a desired volume reduction ratio (or so-called internal compression ratio) is reached, the discharge valve at the flow discharge port is opened and gas flows out into the compressor outlet.

According to conventional theory, there are two distinct thermodynamic processes that occur most often for a PD compressor or expander. The thermodynamic process is adiabatic when compressor or expander discharge pressure is equal to system back pressure (or 100% internal compression or expansion). At this ideal design condition, compressor or expander efficiency, pulsation and induced vibration and noise are most desirable. But more often, a PD compressor or expander operates at off-design conditions where the discharge pressure is either lower or higher than the system back pressure caused by the inherent nature of possessing a fixed built-in volume ratio. The resulting processes are often called under-compression (UC) (also referred to as over-expansion, or OE) and over-compression (OC) (or under-expansion, UE), and the thermodynamic process suddenly changes to iso-choric (constant volume), as shown in the left (UC) and right (OC) figures of FIG. 1*b*. The compressor or expander efficiency, pulsation and induced vibration and noise become worse at these off-design conditions and some type of controls are always desired such as a variable geometry and/or a discharge dampener (silencer) in order to minimize deviation from the ideal design condition. According to the conventional theory, a UC or OC process would result in a rapid induced fluid flow (IFF) into or out of the compressor cavity, as shown in FIG. 2*a*, that takes place one pulse per cavity passing at discharge, the primary driving force of gas pulsations. Since all PD compressors divide the incoming gas stream mechanically into parcels of cavity size for delivery to the discharge, they inherently generate pulsations with cavity passing frequency whenever operating under off-design conditions of either an under-compression or over-compression. An extreme under-compression case is the Roots type blower, shown in FIG. 2*b*, which has no internal compression or the pulsation magnitude is directly proportional to pressure rise from the compressor inlet to outlet and the resulting compression process is purely iso-choric, according to the conventional theory.

The gas pulsation amplitudes are especially significant under elevated pressure conditions, such as in air conditioning and refrigeration or for operating far away from the design condition. Quantitatively, there are orders of magnitude difference between acoustic waves and gas pulsations, though both are pressure fluctuations. For example, acoustic waves are often limited to pressure fluctuations below 140 dB, equivalent to a pressure level of 0.002 Bar or 0.03 psi. For industrial PD type gas machinery, the measured gas pulsations are typically in the ranges of 0.02-2 Bar or 0.3-30 psi (can be even higher), or equivalent to 160-200 dB. So gas pulsation pressure levels are much higher and well beyond the pressure range modeled for the linear acoustics. Moreover, the gas pulsations generated by the compressor discharge pressure difference generally stay within the gas line (often called gas borne) and are periodic in nature. These unsteady gas-pulsation forces would travel at the speed of the wave throughout the downstream piping system and if left uncontrolled, could potentially damage or fatigue pipe lines and equipment, and excite severe vibrations and noises.

To control gas pulsations, a large conventional dampener, usually consisting of several sudden area change plenums connected through a number of chokes (e.g., perforated tubes), is typically located at the flow discharge and connected in series with the discharge port of the transfer chamber of the positive displacement compressors, as shown in FIGS. 2*a*-2*e*. This conventional serial dampener is very effective in gas pulsation attenuation, typically in the range of 20-40 dB, as shown by the experimental results plotted in FIG. 4*g*, but it is often heavy and bulky in size, which creates secondary problems like inducing more vibration and noises due to additional surface area and sheet metal construction, which potentially could result in dampener structure fatigue failures and catastrophic damages to downstream components and equipments.

Moreover, conventional serial dampeners used widely today create additional back pressure that the compressor has to overcome, resulting in doing more work as shown in FIG. 4*f*, hence reducing overall system efficiency across the whole flow range. In addition, compressor efficiency suffers even more at off-design conditions, especially in an over-compression condition. The traditional solution is to use a variable geometry design so that the internal compression ratio can be adjusted to meet different operating conditions. This solution is very complicated structurally with high cost and low reliability. For this reason, PD compressors are often cited unfavorably due to high gas pulsations and induced vibration, noise, and harshness (NVH), and low compressor efficiency, when compared with dynamic type compressors like centrifugal or axial compressors. At the same time, the ever-stringent environmental regulations from the government and growing public awareness of the comfort level in residential and office applications have given rise to an urgent need for quieter and more efficient PD compressors.

Various attempts have been made to replace the conventional serially connected discharge dampener or silencer. One example replacement device for Roots type PD compressors, as disclosed in U.S. Pat. No. 4,215,977 to Weatherston, is designed to feed back a portion of the outlet flow through an injection port to the compressor cavity prior to discharge, in an attempt to equalize the cavity pressure with the outlet hence reducing the pressure spike when the cavity is suddenly exposed to the higher outlet pressure. Other example replacement devices include those for screw compressors as disclosed in U.S. Pat. No. 5,051,077 to Yanagisawa and those for scroll compressors as disclosed in U.S. Pat. No. 5,370,512 to Fujitani et al. However, their effectiveness for gas pulsation attenuation is very limited (e.g., to the level of 5-8 dB, a 2-fold attenuation, as shown by experimental results in FIG. 4*g*), and as such a discharge dampener is still needed in most applications.

It is well known that technological advance is often triggered by new knowledge of the same phenomenon. A new understanding of the gas pulsation and under-compression phenomena will now be discussed. It relates to an unconventional shock tube hypothesis for gas pulsations and under-compression mechanisms. To help understand the theoretical roots, see generally, Huang, P. X., *Gas Pulsations: A Shock Tube Mechanism*. The 2012 International Compressor Engineering Conference at Perdue, 2012, and *Under Compression: An Isochoric or Adiabatic Process*? The 2012 International Compressor Engineering Conference at Perdue, 2012. The shock tube mechanism is based on the well studied physical phenomenon as it occurs in a classical shock tube where a diaphragm separates a region of high-pressure gas from a region of low-pressure gas inside a closed tube, as shown in FIGS. 3*a*-3*b*. According to the shock tube theory, when the diaphragm is suddenly broken, a series of expansion waves is generated, propagating from low-pressure to high-pressure regions at the speed of sound, and simultaneously a series of compression waves quickly coalesces (fully developed) into a shockwave, propagating from high-pressure to low-pressure regions at a speed faster than the speed of sound, inducing rapid fluid flow behind the wave front at the same time.

By analogy, the sudden opening of the diaphragm separating the high and low pressure gases in a shock tube is just like (analogous to) the sudden opening of the compression cavity to the flow discharge port under off-design conditions, because both are transient in nature and driven by the same forces from a suddenly exposed pressure difference. By this correlation, the well established results of the shock tube theory can be readily used to offer insights into mechanism for both gas pulsation and under-compression of any PD type gas machinery such as compressor or expander.

This shock tube mechanism can be summarized into the following gas pulsation rules for industrial gas pulsations that far exceed the upper limit of 140 dB of the classical acoustics. The gas pulsation rules are intended as a simplified way to answer some of the fundamental questions of gas pulsations and under-compression such as: What is the physical nature of gas pulsation and under-compression phenomena? What exactly triggers their happening and where/when? How to estimate quantitatively their magnitude? In principle, these rules are applicable to different gases and for any PD type gas machinery or devices such as engines, expanders, pressure compressors, and vacuum pumps.

1. Rule I: For any two divided compartments, either moving or stationery, with different gas pressures $p_1$ and $p_4$, there will be no or little gas pulsations generated if the two compartments stay divided (or isolated from each other).
2. Rule II: If, at an instant, the divider between the high pressure gas $p_4$ and the low pressure gas $p_1$ is suddenly removed, gas pulsations are instantaneously generated at the location of the divider and at the instant of the removal as a composition of a fan of compression waves (CW) (or a quasi-shockwave), a fan of expansion waves (EW) and an induced fluid flow (IFF), with magnitudes as follows:

$$CW=p_2-p_1=p_1[(p_4/p_1)^{1/2}-1]=(p_4\times p_1)^{1/2}-p_1 \quad (1)$$

$$EW=p_4-p_2=CW*(p_4/p_1)^{1/2}=p_4-(p_4\times p_1)^{1/2} \quad (2)$$

$$\Delta U=(p_2-p_1)/(\rho_1\times W)=CW/(\rho_1\times W) \quad (3)$$

where $\rho_1$ is the gas density at low pressure region, W is the speed of the lead compression wave, and ΔU is the velocity of Induced Fluid Flow (IFF).
3. Rule III: Pulsation component CW is the action by the high pressure ($p_4$) gas to the low pressure ($p_1$) gas, while pulsation component EW is the reaction by low pressure ($p_1$) gas to high pressure ($p_4$) gas in the opposite direction, and their magnitudes are such that they approximately divide the pre-opening pressure ratio $p_4/p_1$, that is, $p_2/p_1=p_4/p_2=(p_4/p_1)^{1/2}$. At the same time, CW and EW pair together to induce the third pulsation component, a unidirectional fluid flow IFF in a fixed formation of CW-IFF-EW.

In general, these gas pulsation rules explain the relationship between an under-compression (or over-compression) and gas pulsations as a cause (pre-opening pressure difference $p_4-p_1$) and the effect (post-opening results) that are the two aspects of the same phenomena. Moreover, Rules I & II give the two sufficient conditions that link the under-compression and gas pulsation events, which are:

a) the existence of a pressure difference $p_4-p_1$ from either an under-compression or over-compression; and b) the sudden opening of the divider separating the pressure difference $p_4-p_1$.

Based on these two conditions, it can be determined that the location and moment that trigger the under-compression action and gas pulsation generation are at the discharge and at the instant when the discharge port suddenly opens. Because all PD compressors or expanders convert energy between the shaft and the gas by dividing the incoming continuous gas stream into parcels of cavity size and then discharging each cavity separately at the end of each cycle, there always exists a "sudden" opening at the discharge phase to return the discrete gas parcels back to a continuous gas stream again. Therefore both sufficient conditions are satisfied at the moment of the discharge opening if the compressor or expander operates at off-design conditions such as an UC (OE) or OC (UE).

Rule I also implies that there would be no or little gas pulsations during the suction, trap/transfer and internal compression (expansion) phases of a cycle because of the absence of either a pressure difference ($p_4-p_1$) or a sudden opening. The focus instead should be placed upon the discharge phase, especially at the moment when the discharge port is suddenly opened and under off-design conditions like either an UC (OE) or OC (UE).

Rule II also reveals the nature and composition of gas pulsations as a combination of large amplitude compression waves (CW) (or a quasi-shockwave), a fan of expansion waves (EW) and an induced fluid flow (IFF). These waves are non-linear waves with ever-changing wave-fronts during propagation. This is in direct contrast to the acoustic waves that are linear in nature and whose wave-fronts stay the same and do not induce a mean through-flow. It is also noted that the three different components (CW, EW and IFF) are generated as a homologous, inseparable whole simultaneously and in a fixed formation CW-IFF-EW. It is believed that this formation reflects the dynamics of the transient under-compression and pulsation events with the wave-fronts CW and EW as the moving forces driving the IFF in between. In turn, the source of CW and EW is simply a re-distribution of the pre-opening under-compression pressure difference $\Delta p_{41}$ that is now being suddenly released and turned into a moving force pushing the flow (IFF) at the front (CW) and pulling the flow (IFF) from behind (EW) at the same time. This new physical picture implies that gas pulsations would be difficult to control because it's not one component (not just IFF as suggested by the conventional theory) but all three components have to be dealt with as a whole.

Rule III shows further that the interactions between two gases at different pressures are mutual so that for every CW pulsation, there is always an equal but opposite EW pulsation in terms of pressure ratio ($p_2/p_1=P_4/p_2$). Teamed together, they induce a unidirectional fluid flow pulsation (IFF) in the same direction as the compression waves (CW).

To better understand the gas pulsation mechanism in light of the gas pulsation rules, let's review the Roots example illustrated in FIG. 3*c* (left figure) again and why just a pre-opening is not enough even though it elongates the time for the gas to discharge. From FIG. 3*c* (right figure), it can be seen that the prior art failed to recognize that the cavity opening would generate a series of compression waves (CW) into the compressor cavity and simultaneous expansion waves (EW) in the opposite direction down-stream. The EW waves have a magnitude of pressure difference $\Delta p_{42}$ even greater than the pressure difference $\Delta p_{21}$ of CW and are left loose to travel downstream at the speed of sound. This mechanism suggests that any effective control has to deal with the combined EW and IFF effects together as the dominant source of gas-borne pulsations for positive displacement gas machinery.

To better understand the UC mechanism in light of the gas pulsation rules, let's examine the above example again. According to the conventional theory, when the cavity gas is suddenly opened to the higher pressure gas at outlet as shown in FIG. 3*c* (left figure), a backflow would rush in compressing the gas inside the cavity iso-chorically. However, according to the shock tube theory, the cavity opening phase in FIG. 3*c* (left figure) resembling the diaphragm bursting of a shock tube would generate a series of compression waves (CW) into the cavity as shown in FIG. 3*c* (right figure). The wave-front sweeps through the low pressure gas and compresses it at the same time at the speed of wave. This results in an almost instantaneous wave compression well before the backflow (behind the contact surface) could arrive because the CW wave travels much faster than the fluid flow (IFF). In this view, the CW waves are the primary force for the under-compression while the backflow is simply an induced gas flow behind the wave after compression takes place. According to the shock tube theory, the wave compression process is adiabatic thermodynamically and governed by the Rankine-Hugoniot Equation, not the Amonton Law for an isochoric process.

Accordingly, it can be seen that needs exist for improvements in positive displacement machinery for reducing gas pulsations to provide induced NVH reductions and improved machinery efficiencies.

SUMMARY

Generally described, the present invention relates to a shunt pulsation trap for positive-displacement gas-transfer machine having a gas transfer chamber with an intake port and a discharge port and having at least one positive-displacement drive device (such as two cooperating rotors) defining a compression region of the transfer chamber. The trap includes a pulsation-trap chamber arranged for parallel fluid flow with the machine transfer chamber. The trap has a first (e.g., inlet) port in communication with the compression region of the transfer chamber (e.g., at least one lobe span away or totally isolated from the transfer-chamber intake port), a second (e.g., discharge) port in communication with the discharge port of the transfer chamber, and at least one pulsation dampener in the pulsation-trap chamber. In this way, the shunt pulsation trap traps and attenuates gas pulsations before discharge from the machinery transfer chamber, thereby reducing induced NVH and improving machinery efficiency.

In one aspect, the invention includes the positive-displacement gas machinery equipped with the shunt pulsation trap. In another aspect, the invention includes the shunt pulsation trap for mounting to or integrally manufacturing with the positive-displacement gas machinery.

Accordingly, it is an object of the present invention to provide a positive displacement gas-transfer machine with a shunt pulsation trap arranged for parallel fluid flow with the machine transfer chamber for trapping and attenuating not only primary pulsations but the secondary induced NVH as well at source.

It is a further object of the present invention to provide a positive displacement gas-transfer machine with a shunt pulsation trap arranged for parallel fluid flow with the machine transfer chamber for improving machine system efficiency by eliminating the serial back pressure resulted from the serially connected dampener at discharge.

It is a further object of the present invention to provide a positive displacement gas-transfer machine with a shunt pulsation trap arranged for parallel fluid flow with the machine transfer chamber that it is lighter in weight and much more compact in size (in some embodiments, at least 10 times smaller in volume) by eliminating the serially connected dampener at discharge.

It is a further object of the present invention to provide a positive displacement gas-transfer machine with a shunt pulsation trap arranged for parallel fluid flow with the machine transfer chamber that it is efficient at off-design conditions by eliminating over-compression.

It is a further object of the present invention to provide a positive displacement gas-transfer machine with a shunt pulsation trap arranged for parallel fluid flow with the machine transfer chamber that is capable of attenuating both the primary pulsations and the secondary induced NVH in a wide range of pressure ratios.

It is a further object of the present invention to provide a positive displacement gas-transfer machine with a shunt pulsation trap arranged for parallel fluid flow with the machine transfer chamber that is capable of attenuating both the primary pulsations and the secondary induced NVH in a wide range of speeds and cavity passing frequencies.

It is a further object of the present invention to provide a positive displacement gas-transfer machine with a shunt pulsation trap arranged for parallel fluid flow with the machine transfer chamber that is capable of achieving a high efficiency and pulsation and induced NVH attenuation in a wide range of pressures and speeds without using a variable geometry and/or serial dampener.

These and other aspects, features, and advantages of the invention will be understood with reference to the drawing figures and detailed description herein, and will be realized by means of the various elements and combinations particularly pointed out in the appended claims. It is to be understood that both the foregoing summary and the following brief description of the drawings and detailed description of the example embodiments are explanatory of example embodiments of the invention, and are not restrictive of the invention, as claimed.

DETAILED DESCRIPTION OF EXAMPLE EMBODIMENTS

Before describing details of the invention, a background understanding of certain underlying technological concepts and principles will be summarized.

Underlying Technological Concepts and Principles

Figure 4A:
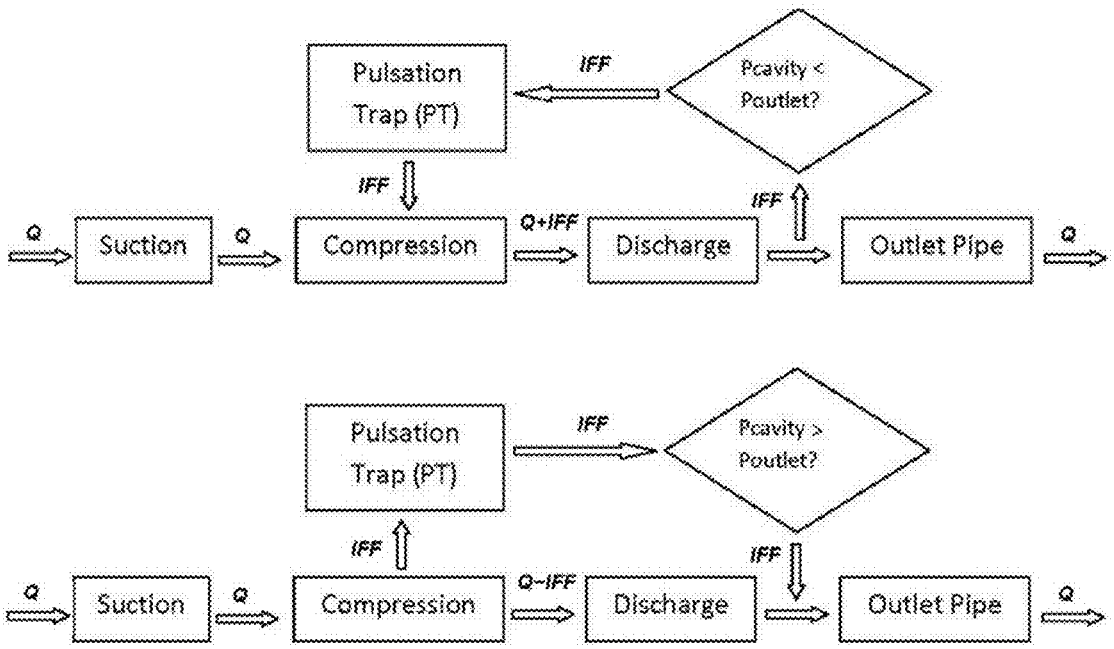
FIG. 4*a* is two flow diagrams of a positive-displacement compressor with a shunt pulsation trap according to the invention, showing the new compression cycle for an under-compression (top diagram) and an over*compression (bottom diagram).

As discussed in the background section, UC is inherently an adiabatic thermodynamic process, and based on that insight a composite design strategy can be devised so that PD compressors will work either under internal compression or under UC, but never under OC, in order to maximize average system efficiency and minimize pulsations and noises at the same time. FIG. 4*f* shows the composite adiabatic compression process with an initial internal compression that is joined by a UC, and the potential power savings using this scheme. Both processes are adiabatic in nature but with a slight difference in efficiency (slope of the curve on P-V diagram). The down-side of employing this composite process is the generation of gas pulsations during a UC as discussed above. To achieve the combined effects of good average system efficiency and reduced gas pulsations (the combined EW and IFF effects) and induced NVH, a new control system and method called shunt pulsation trap has been devised as follows.

Basic designs of the shunt pulsation trap and its configuration relative to a positive-displacement fluid machine are disclosed in five priority U.S. patent applications by the applicants all of which have been incorporated herein by reference: Ser. No. 13/155,123 filed Jun. 7, 2011, for a "Rotary Lobe Blower with a Shunt Pulsation Trap," Ser. No. 13/340,592 filed Dec. 29, 2011, for a "Screw Compressor with a Shunt Pulsation Trap," Ser. No. 13/404,022 filed Feb. 24, 2012, for a "Shunt Pulsation Trap for Positive Displacement Compressors," Ser. No. 13/621,202 filed Sep. 15, 2012, for a "Shunt Pulsation Trap for Positive Displacement Internal Combustion Engines," and Ser. No. 14/285,678 filed May 23, 2014, for a "Scroll Compressor with a Shunt Pulsation Trap." These various embodiments of a shunt pulsation trap are configured and operable to trap and attenuate gas pulsation before discharge from the positive-displacement fluid machine.

Figure 3A:
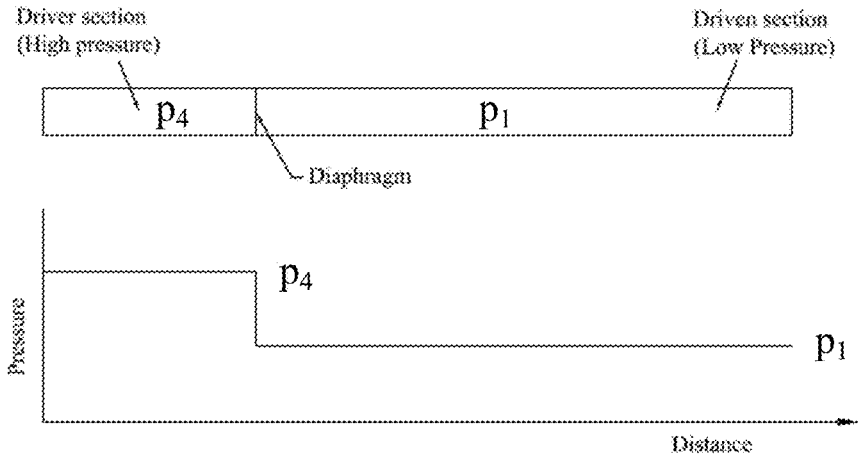
FIGS. 3*a* and 3*b* each show a shock tube device (top figures in each) and pressure and wave distribution (bottom figures in each) before and after the diaphragm is broken, according to a shock tube theory.
Figure 3B:
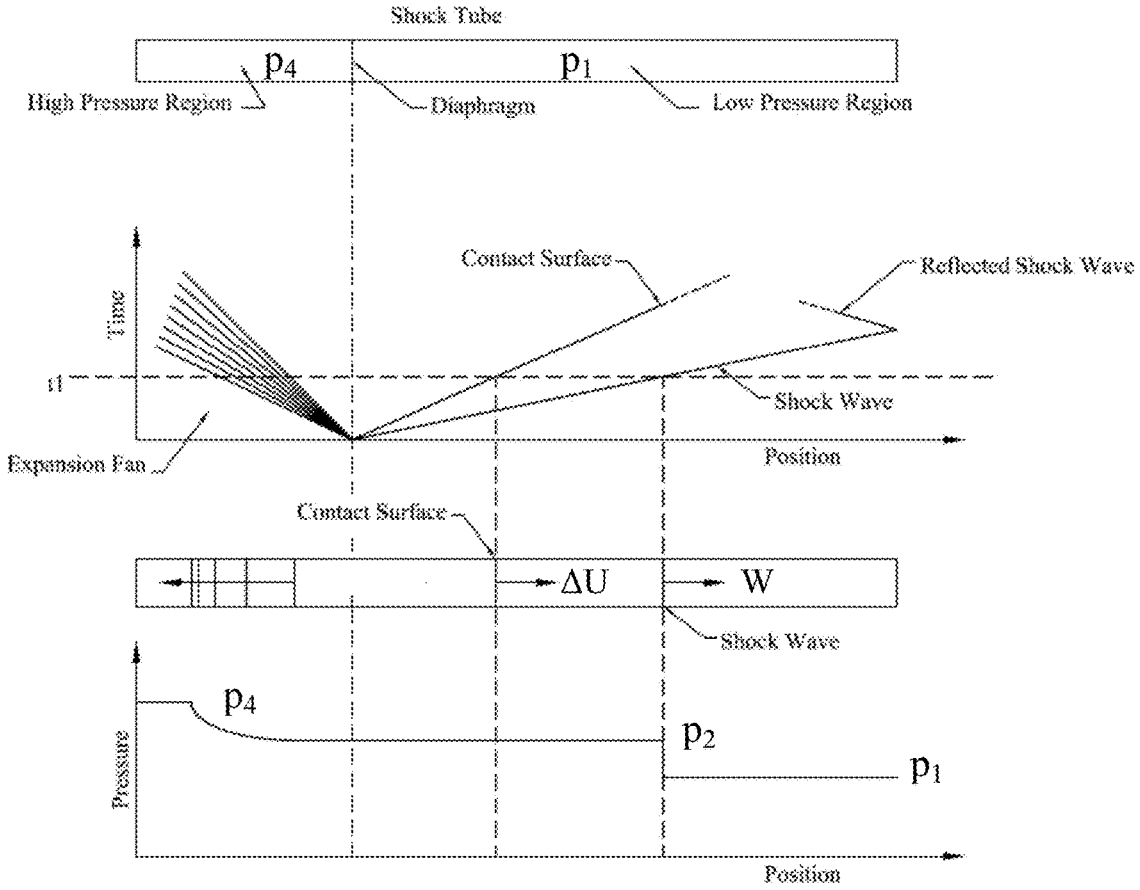
Figure 3C:
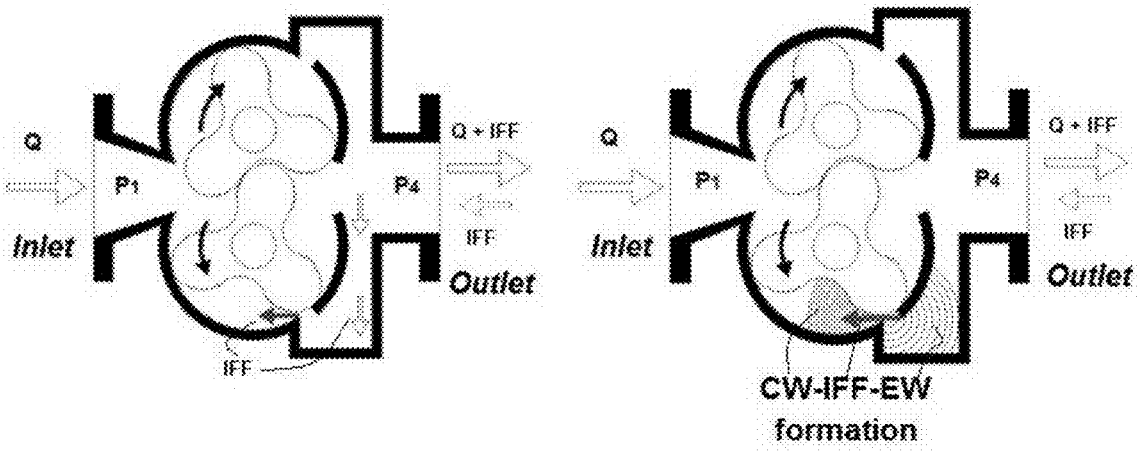
FIG. 3c (Prior Art)
FIGS. 3*c* to 3*f* each show two schematic views of the triggering mechanism at the sudden discharge opening of a conventional under-compression and induced CW and EW waves and IFF for Roots, screw, scroll, and reciprocating compressors, respectively, according to the shock tube theory.
Figure 3D:
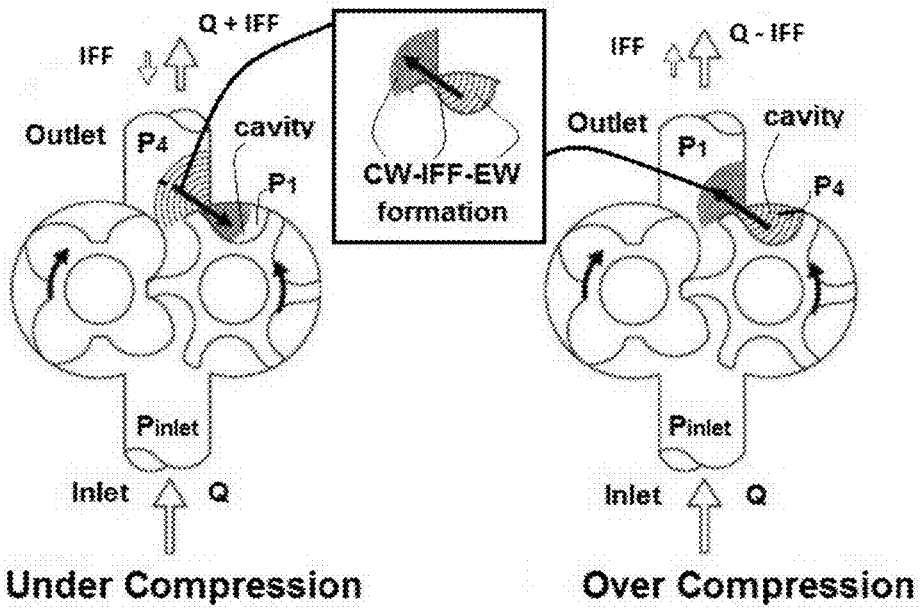
FIG. 3d (Prior Art)
Figure 3E:
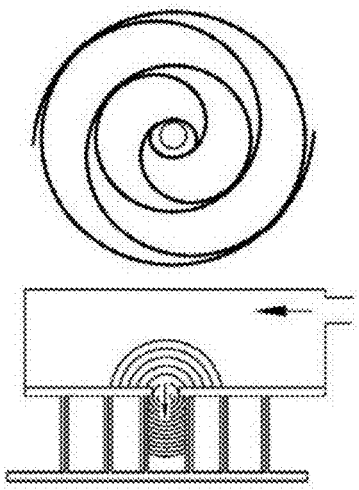
FIG. 3e (Prior Art)
Figure 3F:
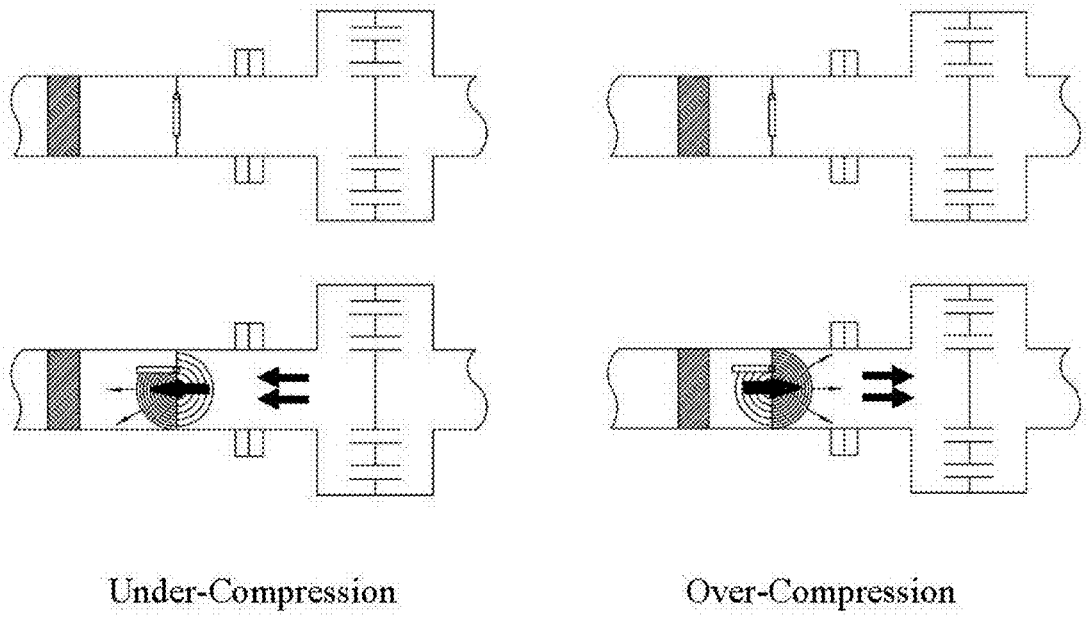
FIG. 3f (Prior Art)
Figure 4B:
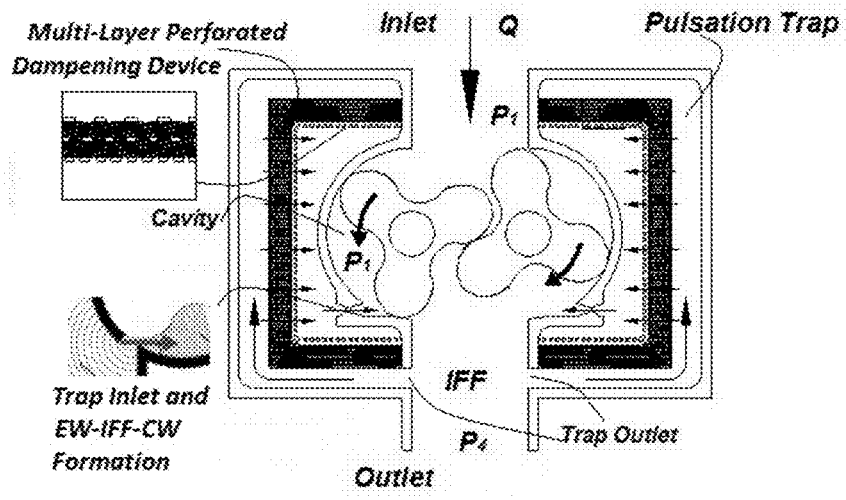
FIG. 4*b* is a cross-sectional side view of a Roots-type positive-displacement compressor with a shunt pulsation trap according to a first embodiment of the invention, showing the sudden triggering moment at the trap inlet according to the shock tube theory.
Figure 4C:
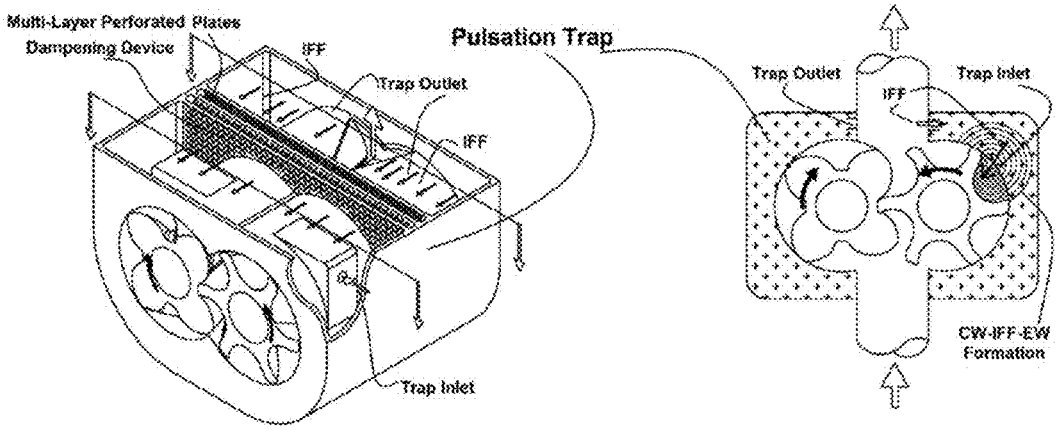
FIG. 4*c* is a perspective cut-away view (left figure) and a schematic side view (right figure) of a screw-type positive-displacement compressor with a shunt pulsation trap according to a second embodiment of the invention, showing the sudden triggering moment at the trap inlet according to the shock tube theory.
Figure 4D:
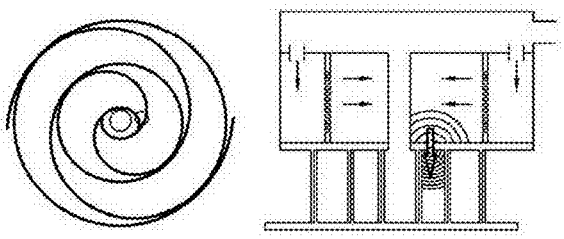
FIG. 4*d* is a schematic view (left figure) and a cross-sectional side view (right figure) of a scroll-type positive-displacement compressor with a shunt pulsation trap according to a third embodiment of the invention, showing the sudden triggering moment at the trap inlet according to the shock tube theory.
Figure 4E:
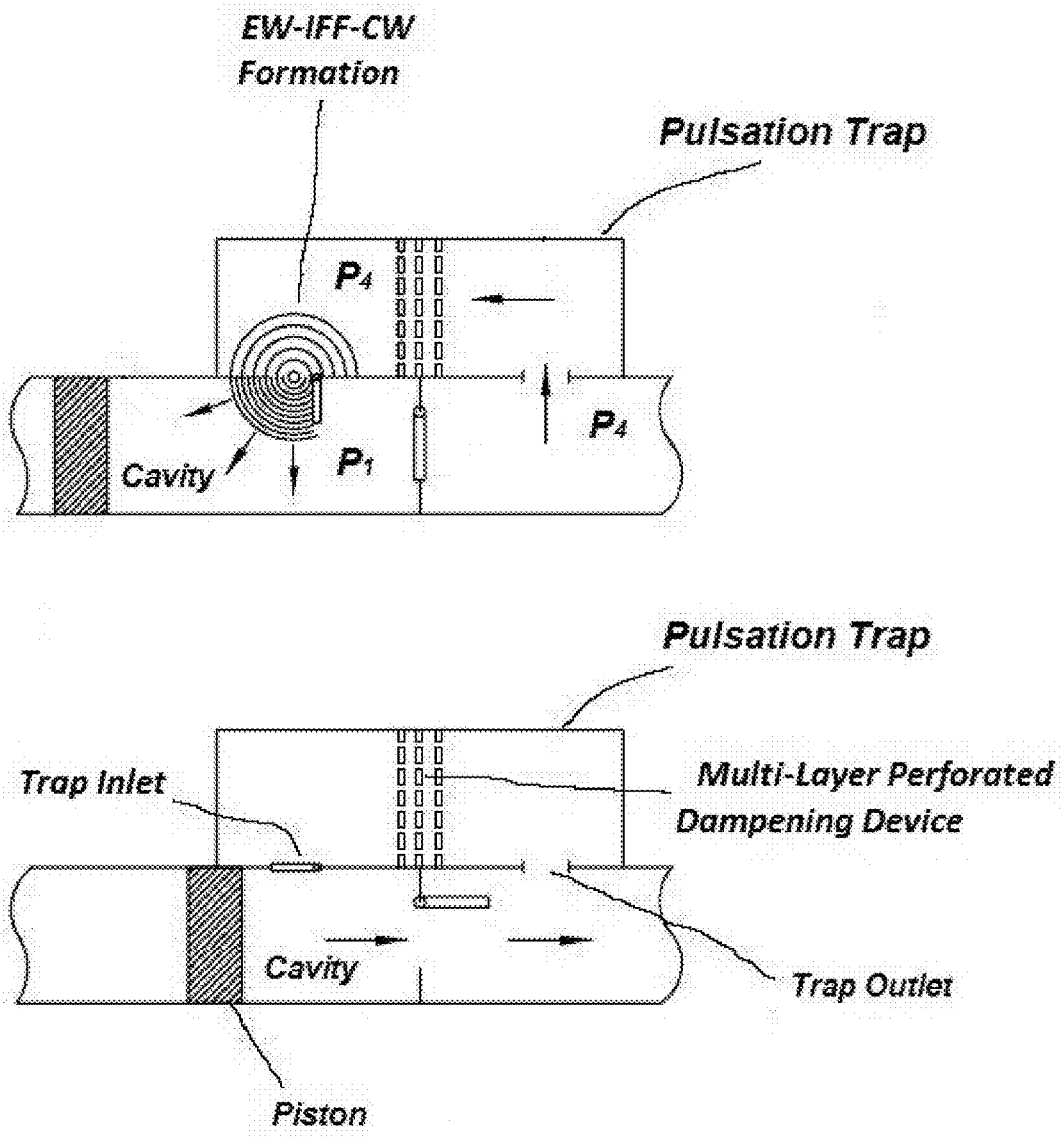
FIG. 4*e* is two (top and bottom) schematic side views of a reciprocating-type positive-displacement compressor with a shunt pulsation trap according to a fourth embodiment of the invention, showing the sudden triggering moment at the trap inlet according to the shock tube theory.
Figure 4F:
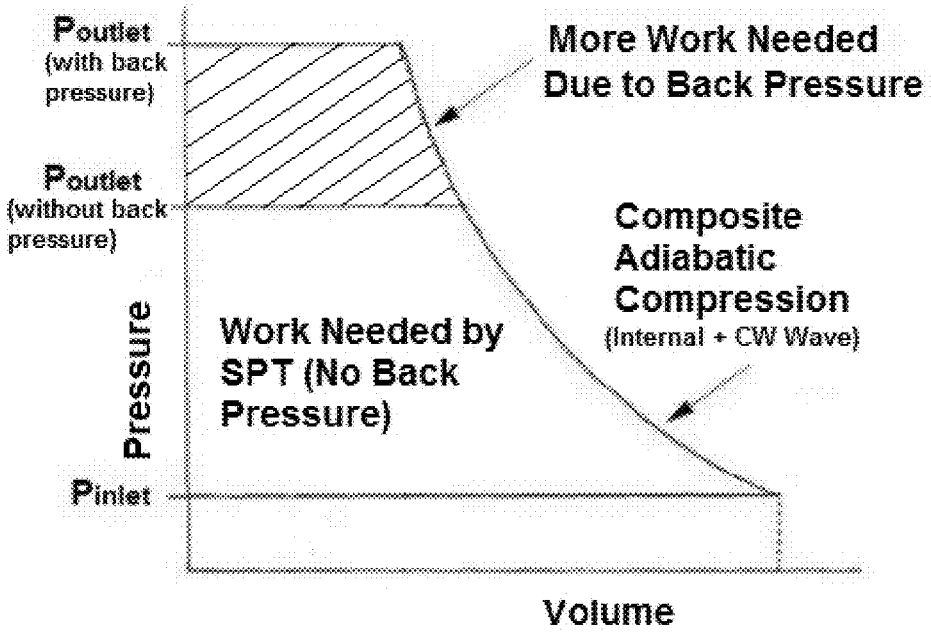
FIGS. 4*f* to 4*g* are a P-V diagram and a pulsation attenuation graph showing a comparison of work saving and pulsation attenuation between serial dampening (prior art) and an example shunt pulsation trap of the present invention.

The operating principle of such shunt pulsation traps can be illustrated with the Roots example by comparing a conventional pre-opening serial dampener as shown in FIG. 3*c* (right figure) with FIG. 4*b* showing a shunt pulsation trap during compression phase. According to the gas pulsation rules, a series of waves and flow in the formation of CW-IFF-EW are triggered at the pre-opening (or trap inlet) as soon as the cavity is opened to the pressure difference between the outlet and cavity (relates to inlet pressure). The generated CW waves or shockwaves travel into the low pressure cavity compressing the gas inside, and at the same time, the simultaneously generated EW waves on the high pressure side are left loose into the outlet pipe, forming part of the gas pulsations. For the shunt pulsation trap, the EW waves and induced flow IFF enter the pulsation trap chamber where they are attenuated by one or more of various dampeners or dampening devices before they travel downstream. The shunt pulsation trap of FIG. 4*b* includes a dampener in the form of a perforated plate and is used with a Roots compressor, whereas a perforated-plate dampener is used in a shunt pulsation trap with other types of compressors in FIGS. 4*c* to 4*e* in the same way as for Roots by targeting attenuation of the primary gas pulsation energy at cavity passing frequency.

Figure 4G:
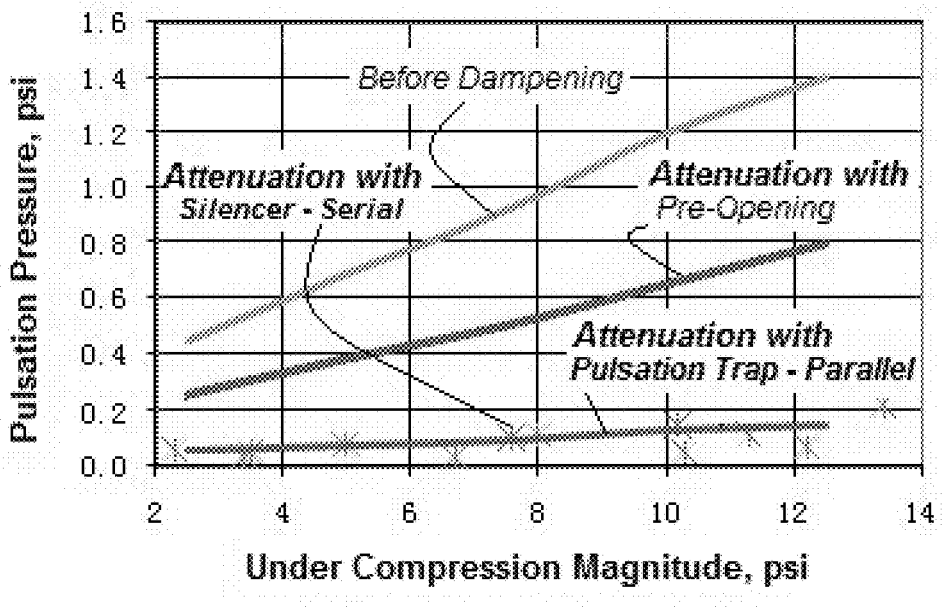

The use of a perforated-plate dampener inside a shunt pulsation trap can be as effective at pulsation attenuation as conventional serial dampening, as shown by the experimental results in FIG. 4*g*: at least a 10-fold pulsation reduction in pulsation pressures for the units tested. However, the shunt pulsation trap also achieves energy savings (as illustrated in FIG. 4*f*) and space/weight savings at the same time. A serious side effect of using the shunt pulsation trap is the generation of a wide spectrum of secondary vibration and noise by the perforated-plate dampener itself as it is excited by the strong EW waves and induced fluid flow (IFF) inside the pulsation trap, the so called "drum effect".

A Roots-compressor embodiment depicted in the lower exploded view of FIG. 4*b* (insert at left bottom) shows a shunt pulsation trap with an inlet (injection port) having a straight rectangular shape, which can be in any of various cross-sectional profiles (such as cylindrical orifice, flow nozzle, or De Laval nozzle profile). Though effective at improving induced fluid flow (IFF) into the cavity, these inlet designs do not address the "suddenness" of the trap inlet opening because the shorter the opening time is, the stronger the resulting EW & CW waves and IFF according to the shock tube theory.

The present invention, as illustrated by the various embodiments described and depicted herein, provide dampening devices that balance the forces induced by IFF and EW or CW waves inside a shunt pulsation trap to undergo self-cancellation, thus exciting no or little secondary vibration and noise. Moreover, the injection port (trap inlet) is devised with a shape to undergo a gradual opening from compressor cavity into the pulsation trap chamber.

Application of the Underlying Technological Concepts and Principles

Although specific embodiments of the present invention will now be described with reference to the drawings, it should be understood that such embodiments are examples only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

It is to be understood that the present invention is not limited to the specific devices, methods, conditions, or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about"

one particular value and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
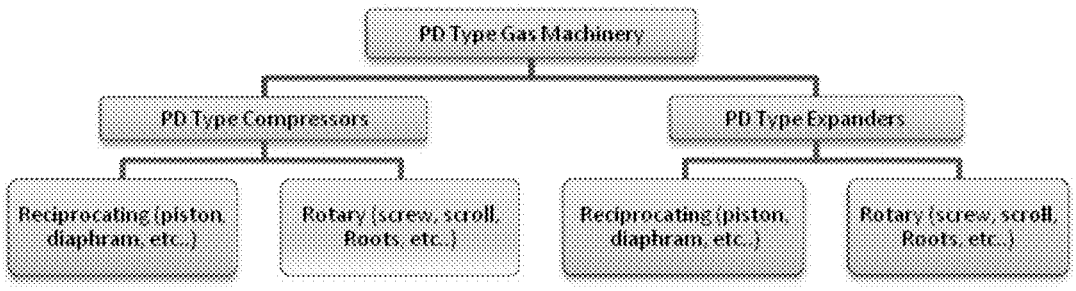
FIG. 1*a* is a classification chart for PD type gas machinery that is divided into compressors/expanders, and further sub-divisions into Roots, screw, scroll and reciprocating as examples covered under the present invention.
Figure 1B:
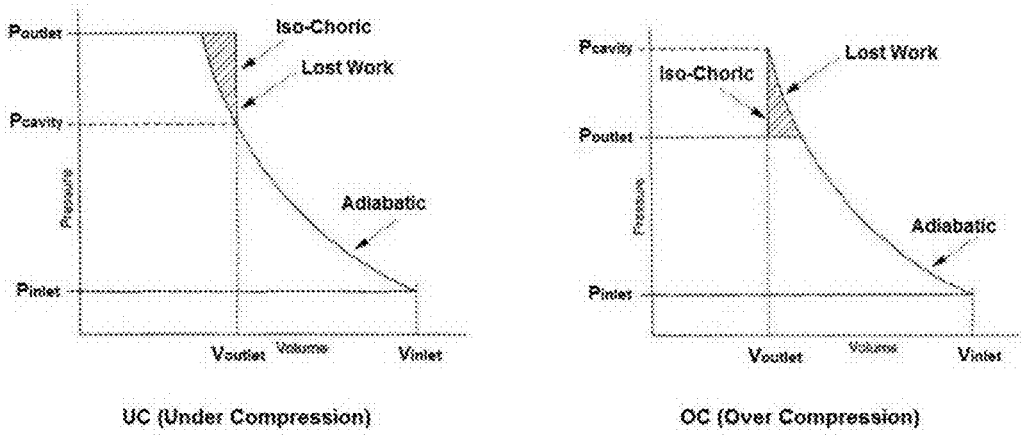
FIG. 1*b* is two P-V diagrams showing a conventional under-compression process (left diagram) and a conventional over-compression process (right diagram).
Figure 2A:
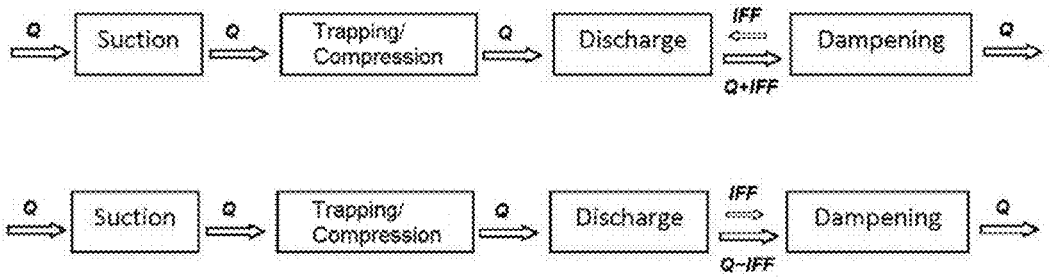
FIG. 2a (Prior Art)
FIG. 2*a* is two flow diagrams of a conventional positive-displacement compressor, showing an under-compression cycle (top diagram) and an over-compression cycle (bottom diagram) cycle
Figure 2B:
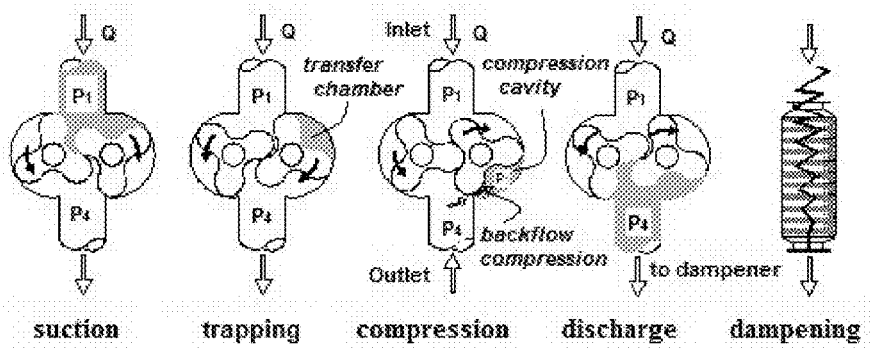
FIG. 2b (Prior Art)
FIGS. 2*b* to 2*e* are each a series of individual figures, each showing the phases of a conventional compression cycle and serial dampening, according to FIG. 2*a*, for Roots, screw, scroll, and reciprocating compressors, respectively.
Figure 2C:
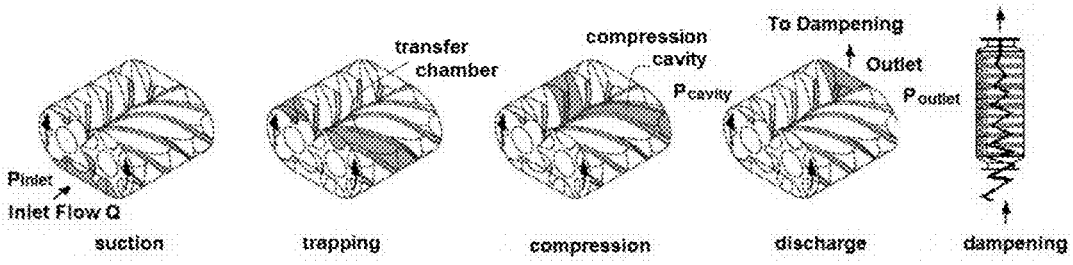
FIG. 2c (Prior Art)
Figure 2D:
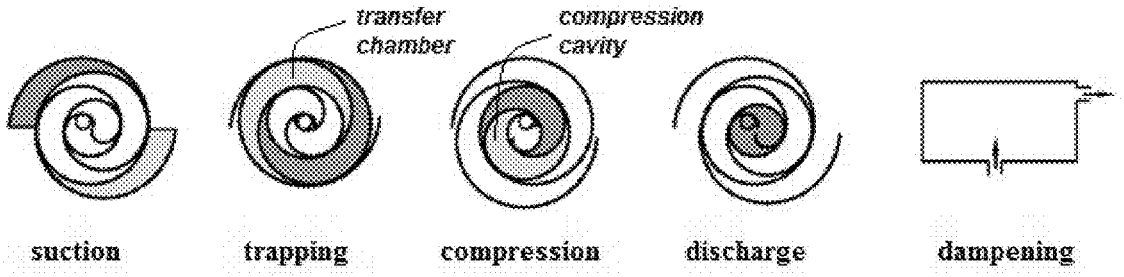
FIG. 2d (Prior Art)
Figure 2E:
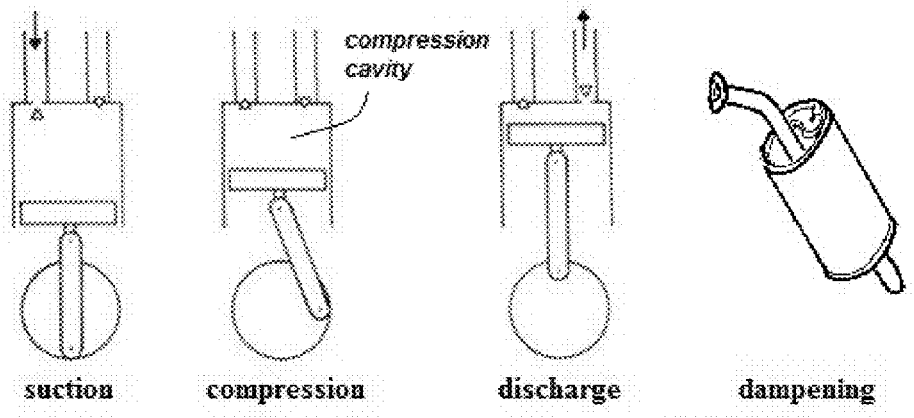
FIG. 2e (Prior Art)

It should also be pointed out that though most drawing illustrations and description are devoted to a Roots type gas machine with a shunt pulsation trap for controlling gas pulsations under an under-compression mode, this is just one of many types of positive displacement fluid machines and shunt pulsation traps of the present invention, as the same principles can be applied to other types of positive displacement compressors and expanders, whether reciprocating (e.g., reciprocating or diaphragm) or rotary (e.g., Roots, screw, or scroll), for example as shown in FIGS. 4*b*-*e*, or any other type identified in FIG. 1*a*, because they are all targeted to eliminate the serially connected dampener or silencer as shown in FIG. 2*a* and all produce the same new parallel pulsation control cycle—a feedback control loop as shown in FIG. 4*a*. The same is true for other gas media such as gas-liquid two phase flow as used in air conditioning or refrigeration. In addition, the positive displacement expander is a variation that operates under the same principles except reversed for being used to generate shaft power from media pressure drop.

To illustrate the principles of the present invention, FIG. 4*a* shows a new cycle of a positive displacement compressor with the addition of a shunt (parallel) pulsation trap according to a first example embodiment of the present invention, linking the compression phase to the discharge pressure. In broad terms, a shunt pulsation trap is used to trap and to attenuate pulsations in order to reduce the primary gas borne pulsation before discharging to downstream or releasing to atmosphere. As shown in FIG. 2*a*, a discharge dampener is a conventional pulsation dampening device which is connected in series with the compressor discharge port, indiscriminating "pulsed flow (IFF)" and "main flow (Q)". On the other hand, the strategy for shunt pulsation trap is to separate "main flow (Q)" from "pulsed flow (IFF)" so that only "pulsed flow (IFF)" will go through the dampener and be attenuated there. As illustrated in FIG. 4*a*, the phases of flow suction and compression are still the same as those shown in FIG. 2*a* of a conventional serial dampening cycle. But just before the compression phase finishes and the discharge phase begins, a parallel link is established between the compression cavity and the discharge port by a pre-opening port, also called a pulsation trap inlet, that is located just before the compressor discharge port and timed to open just before the compression phase finishes, as shown in various examples in FIGS. 4*b*-4*e*. The trap inlet is branched off from the compressor cavity into a parallel chamber, also called a pulsation trap chamber, which is also communicating with the compressor outlet through a feedback region called trap outlet located opposite to trap inlet, as shown in FIGS. 4*b*-4*e*. Between the trap inlet and outlet, and within the trap chamber, there exists one or more pulsation dampening devices (also referred to herein as "dampeners") to control (e.g., reduce, recover, and/or contain) pulsation energy before it travels to the compressor outlet. (In the depicted embodiment, each dampener is provided by a perforated plate, for example a conventional multi-layer flat-panel design used for dampening, that extends all the way across the trap chamber from wall to wall and is positioned between the trap chamber ports so that the flow must pass through the perforated plate, and that is configured for example in the depicted "C" shape and size to generally surround the machine compression region of the transfer chamber, while in other embodiments each dampener is provided by a perforated tube, diaphragm, piston, Hemholtz resonator, valve, combination thereof, or other device for dampening pulsation as is known in the art.) The strategy is to induce or separate out "pulsed flow (IFF)" from "main flow (Q)" before it reaches the discharge. After being separated, the "pulsed flow (IFF)" is trapped inside the trap chamber and attenuated by the dampener while the "main flow (Q)" stays inside the compression region of the transfer chamber and waits to be discharged. As shown in FIG. 4*b* for case of a Roots compressor, at the moment when the compression region of the transfer chamber is suddenly opened to the trap inlet while still being closed to the compressor discharge, a series of waves and flows would be produced at trap inlet if there is a pressure difference between the pulsation trap (relates to compressor outlet pressure) and compressor cavity (relates to compressor inlet pressure). For an under-compression, compression waves or a quasi-shockwaves are generated into the low-pressure cavity increasing its pressure and inducing a back-flow into the cavity at the same time, while on the other side, simultaneously generated expansion waves travel into the high-pressure trap and are attenuated. Because these waves travel at a speed typically about 5-20 times faster than the fluid flow through the cavity (and faster than for example the fluid-driving linear piston or the rotary lobe), the pressure equalization inside the cavity and the pulsation attenuation inside the trap volume are almost instantaneous and are finished before the compressor cavity reaches the discharge phase. Therefore, at the moment when the compressor cavity is opened to the compressor discharge, the pressure inside the cavity is already equal to the outlet pressure, hence discharging pressure-difference free, hence a pulsation-free gas flow. The same principle applies to an over-compression condition but with reversed wave patterns and induced flow as shown in the bottom illustration of FIG. 4*a*.

The principal difference with a conventional positive displacement compressor is in the discharge and dampening phase: instead of waiting and delaying the dampening action after the discharge by using a serially-connected dampener, the present invention shunt pulsation trap starts dampening before the discharge by inducing only the pulsed flow (IFF) and EW into the trap. It then dampens the IFF and EW pulsations within the trap simultaneously as the compressor cavity travels to the outlet. In this way, the main flow (Q) inside the compressor cavity and the pulsed flow (IFF) are separated and in parallel with each other so that attenuating the "bad" pulsed flow (IFF) will not create any serial back-pressure to the compressor to affect the load and hence the efficiency of the compressor system.

There are several advantages associated with the parallel pulsation trap compared with the traditional serially connected dampener, of which a few will be discussed. First of all, the pulsed flow (IFF) is separated out from the main cavity flow (Q) through a parallel dampener so that an effective attenuation on pulsed flow (IFF) will not create any serial back pressure for the compressor to overcome, resulting in saving work as shown in FIG. 4*f*, hence enhancing both the compressor system efficiency across the whole flow range and the pulsation attenuation effectiveness with a much smaller-sized dampening device (e.g., at least 10 times smaller in volume). In a conventional serially connected dampener, both pulsed flow (IFF) and main flow (Q) travel through the dampening device where a better attenuation on pulsed flow (IFF) always comes at a cost of higher compressor back pressure or larger dampener size to accommodate the combined Q and IFF flow. A compromise is often made in order to reduce either compressor back pressure by sacrificing the degree of pulsation dampening or having to use a very large volume dampener, resulting in a bulky, heavy and costly dampener. Secondly, by pre-opening to outlet pressure, the compression mode is switched from the 100% internal volume ratio controlled compression to a portion with under-compression, or shock-wave compression according to the shock tube theory. A composite process of internal compression with a portion of under-compression is always a preferred mode (in dealing with off-design inefficiency) by eliminating the over-compression condition. As shown in FIGS. 4*b*-4*e*, the degree of pre-opening depends on the width of the range of the off-design so that the overall compressor efficiency is further increased by this composite compression process. Thirdly, the parallel/shunt pulsation trap attenuates pulsation much closer to the pulsation source than a serial one and is capable of using a more effective pulsation dampening device of a much smaller size without creating any serial back-pressure affecting compressor efficiency. Hence it can be built as an integral part of the casing as close as possible to the compressor cavity or in a conforming shape of the compressor cavity so that overall size and footprint of the compressor package is much smaller. By replacing the traditional serially connected dampener with a more compact parallel pulsation trap, the secondary induced vibration and vibrating surfaces (and hence noise radiation) are much more reduced too. Moreover, the pulsation trap casings can be made of a metal casting that will be more wave or noise absorptive, thicker and more rigid than a conventional sheet-metal serial dampener casing, thus further reduce induced noise and vibration.

Figure 5A:
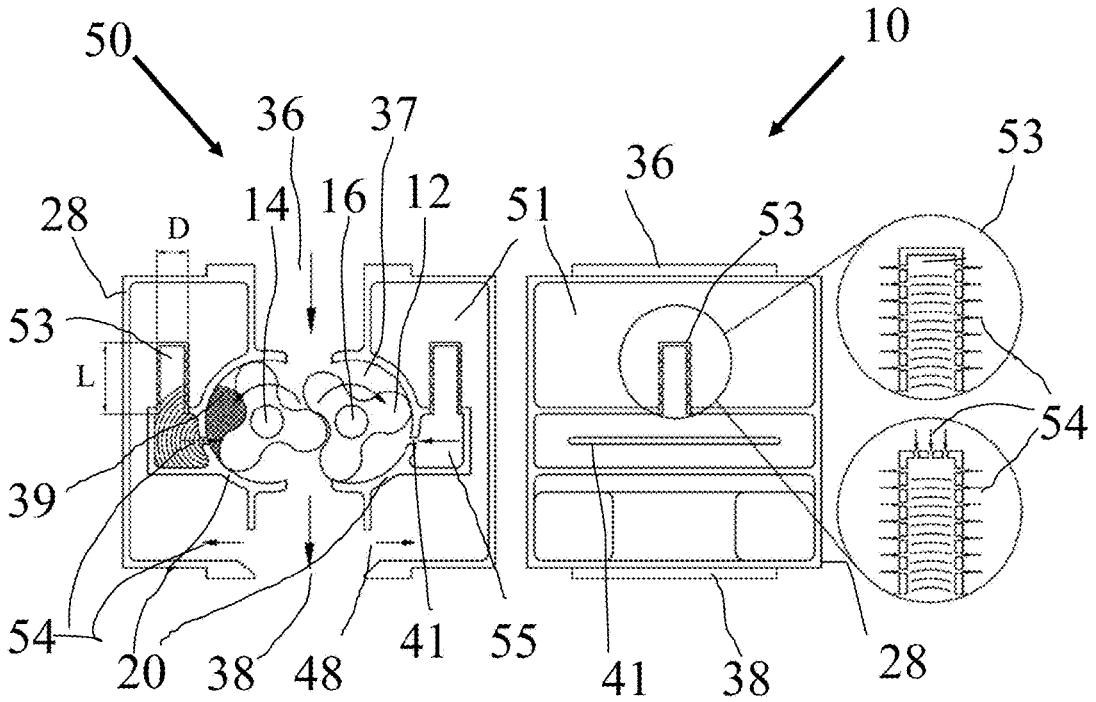
FIG. 5*a* is a cross-sectional side view (left figure) and a cross-sectional end view (right figure) of a Roots-type positive-displacement compressor with a shunt pulsation trap according to a first alternative embodiment of the invention, showing a single (per side of the trap chamber) non-flat perforated dampener.

Referring to FIG. 5*a*, there is shown a positive displacement Roots type compressor (aka blower) 10 with a shunt pulsation trap apparatus 50 according to a first example embodiment of the invention. The Roots blower 10 has parallel rotors 12 (typically two of them, as shown) mounted on rotor shafts 14 and 16 (typically two of them, as shown), with each of the rotors having a plurality of radially-arranged lobes, each lobe having a tip. Typically, one of the rotor shafts 14 or 16 is driven by an external rotational driving mechanism such as a rotary driveshaft driven by a motor (not shown) through a set of timing gears (not shown) to drive the rotors 12 in synchronization without touching each other for propelling the flow from an intake (e.g., suction) port 36 to a discharge port 38 of the transfer chamber 37 of the blower 10. The rotary Roots blower 10 also has a casing 20 forming an integral part of the transfer chamber 37, and an internal bearing support structure (not shown) to which the rotor shafts 14 and 16 are rotationally mounted. Also included is a trap casing 28 with a space maintained between the transfer (inner) casing 20 and the trap (outer) casing 28 forming the pulsation trap chamber 51, in embodiments in which the pulsation trap is integrally formed with the compressor (in other embodiments they are separately provided and assembled together).

The trap casing 28 of the shunt pulsation trap apparatus 50 can surround a substantial portion of the rotary blower 10 (for example, it can enclose the transfer (inner) casing 20 completely except for the below-described trap inlet 41 and outlet 48), and two cross-section views of this are illustrated in FIG. 5*a*, with the right figure a cross-section taken through the trap chamber (not the transfer chamber) of the left figure. The trap casing 28 of the shunt pulsation trap apparatus 50 can thus be formed as a single casing with a divider wall forming the two trap chambers 51, or with two separate outer casings if so desired. In the embodiment illustrated, the shunt pulsation trap apparatus 50 further includes an injection port (aka a trap inlet) 41 (e.g., a slot elongated along the flow direction through the transfer chamber 37, as depicted, or another conventional flow opening) branching off from the transfer chamber 37 into the pulsation trap chamber 51 and a feedback port (aka a trap outlet) 48 communicating with the blower outlet 38. And at least one pulsation dampener 53 is mounted within the trap chamber 51. Each rotor 12 forms a compression region (discussed below), so at least one trap chamber 51 is provided for each rotor, for example in the depicted embodiment with two rotors there are two trap chambers and at least two dampeners 53. In some embodiments such as that depicted, the dampener 53 is positioned covering a transition port of a transitional chamber 55 positioned within the trap chamber 51 and surrounding the trap inlet 41 so that the flow must pass through the perforated plate, the transition port, and the transition chamber in series when traveling between the trap outlet port 48 and the trap inlet port 41. The transitional chamber 55 can be elongated along the flow direction through the transfer chamber 37, with all or parts of its casing (defining the transition chamber) being integrally formed with the transfer casing 20 and made of the same conventional material. Immediately after each lobe tip of each rotor 12 passes (clears) the trap inlet 41 (as shown for the left rotor in FIG. 5*a*), a series of compression waves are generated at the trap inlet 41 going into the compression region 39 (the portion of the transfer chamber/cavity 37, at any given time, between the inwardly-facing opposing surfaces of two adjacent rotor lobes and the inner surface of the transfer casing 20) inducing a feedback flow (IFF) 54. ("The compression region" is the portion of the transfer chamber where gas compression takes place concurrently with pulsation dampening in the shunt pulsation trap. For a Roots PD device, the compression force comes from exposing the transfer chamber to the trap or outlet pressure that is different from the chamber/cavity pressure. For other PD applications such as a reciprocating piston PD device, the compression force comes from the cavity volume change driver such as a piston or screw lobes that squeeze the gas inside the chamber/cavity. Thus, for a Roots PD device the compression region is defined/sealed by the rotating lobes and the transfer-chamber wall, whereas for a piston PD device it's defined/sealed by the reciprocating piston/driver, the transfer-chamber walls, and closed valves, with the compression region being totally isolated from the suction/discharge ports to achieve the gas compression.) Simultaneously, a series of expansion waves are generated at the trap inlet 41, but travelling in a direction opposite to the feedback flow, that is from the trap inlet 41, going through the transitional chamber 55 and then through the dampener 53, before reaching the trap outlet 48 and then the blower outlet 38. In FIG. 5*a*, the large arrows show the direction of rotation (the two oppositely-pointed angular arrows) and main transfer chamber/cavity flow (the two vertical, downward-pointed, linear arrows) as propelled by the rotors 12 from the suction port 36 to the discharge port 38 of the blower 10, while the feedback flow (IFF) 54 is indicated by the small arrows (the two pairs of horizontal, linear arrows) going from the feedback port (trap outlet) 48 into the pulsation trap chamber 51, then going through the dampener 53 into the transitional chamber 55 and converging to the injection port (trap inlet) 41 and releasing into the compression chamber 39. For other types of rotary PD machines, the rotors are provided by other types of positive-displacement drive devices such as srews or scrolls, and for reciprocating PD machines the positive-displacement drive devices are for example pistons or diaphragms.

For the rotary blower 10 equipped with the shunt pulsation trap apparatus 50, there exists a high gas pulsation and induced NVH reduction at source and improved compressor design and off-design efficiency, without using a traditional serial pulsation dampener and/or a variable geometry, while being light in mass, compact in size, and suitable for high-efficiency, variable-pressure ratio applications at the same time.

As will be understood from the drawings, one lobe span for a Roots blower is the distance around the circumferential arc of the transfer chamber 37 between the tip of one lobe of a rotor 12 and the tip of the adjacent lobe of the same rotor. Thus, in the left figure of FIG. 5*b*, referring to the right rotor 12, as one rotor lobe tip is rotationally about to close off the intake port 36 of the transfer chamber 37 to form the compression region 39, the adjacent leading rotor lobe tip is rotationally approaching (but has not reached) the trap inlet 41 and will not do so until the trailing lobe has closed off the intake port. And referring to the left rotor 12 in the left figure of FIG. 5*b*, after the trailing rotor lobe rotationally closes off the intake port 36 of the transfer chamber 37 to form the compression region 39 (totally isolated from the intake port 36), the adjacent leading rotor lobe tip rotates past the trap inlet 41 so that the compression region 39 is now in communication with the trap chamber 51 via the trap inlet 41. For other types of rotary PD machines, such as screw and scroll, the lobe span and compression region are similarly defined (based on the type of the positive-displacement drive device) to be totally isolated from the intake port. And for reciprocating PD machines, the compression region is similarly defined but formed by the isolated cavity between the cylinder wall and piston with both intake and discharge valves closed, as understood in the art.

The theory of operation underlying the shunt pulsation trap apparatus 50 is as follows. As illustrated in FIG. 5*a* during the compression phase, instead of waiting to be opened to the blower outlet 38 (as the conventional rotary lobe blower does), the trapped flow inside the compression region 39 of the transfer chamber 37 is pre-opened to the injection port (or trap inlet) 41 that is at least one lobe span away or totally isolated from the suction port 36 opening (for a 3-lobe Roots blower, one lobe span is 120 degrees). As shown in FIG. 5*a*, a series of compression waves or a shock wave are produced due to a pressure difference between the transitional chamber 55 (close to outlet pressure) and transfer chamber 37 (close to inlet pressure). The compression waves traveling into the transfer chamber 37 (now becoming compression chamber 39) compress the trapped gas inside, but at the same time, the accompanying expansion waves EW and IFF enter the transitional chamber 55 and dampener 53, and therein are being attenuated by the dampener 53, shown for example as a single perforated tube. Because the compression waves travel at a speed about 5-20 times faster than the rotor 12 tip speed, the attenuation is well under way even before the lobe tip reaches the blower outlet opening 38, hence discharging a pulsation-free or pulsation-reduced flow. The pulsation trap dampener 53 can be specifically selected for achieving optimum attenuation, so the pulsation reduction can be quite significant so that a conventional externally connected serial pulsation dampener is not needed anymore at the outlet, thus saving energy, space and weight.

Referring particularly to the two exploded views of the right figure of FIG. 5*a*, the dampening device 53 can be provided by at least one cylindrical-shaped perforated tube (one end covered by an endwall and the opposite end open) per rotor 12. The perforated-tube dampener 53 is mounted to the casing of the transition chamber 55 with the open end of the perforated-tube dampener communicating with the transition port of the transition chamber. In comparison with the shunt pulsation trap apparatus 40 with the dampening device including at least one layer of perforated dampening device shown in FIG. 4*b* the induced flow IFF by EW waves through the holes of the perforated tube 53 are now symmetrical and the induced forces that excite the secondary vibration and noise are hence cancelled out throughout the entire perforated surface of the dampener 53. Moreover, the perforated tube can be of a cylindrical shape with a length (L) to diameter (D) ratio of at least 2:1 so that the total cylindrical surface area is much larger than the flat endwall area that acts like a drum, hence eliminating the so called "drum effect". Alternatively, the endwall of the perforated-tube dampener can be equipped with at least one hole as shown in the bottom exploded illustration of the right view of FIG. 5*a* so that the exciting forces of the EW waves are further turned into induced flow IFF 54. Furthermore, the endwall of the perforated-tube dampener can be provided with a hemi-spherical shape (not shown) that is structurally more rigid and less likely to be excited.

Figure 5B:
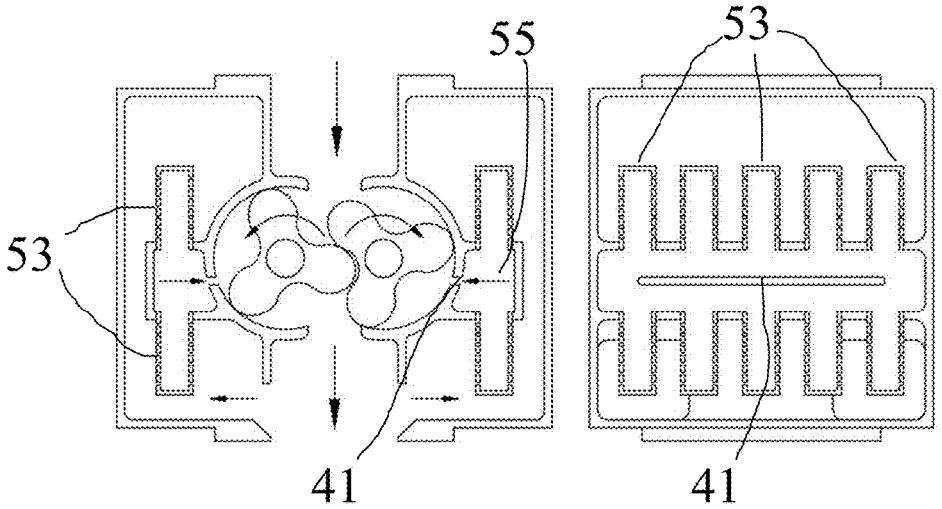
FIG. 5*b* is a cross-sectional side view (left figure) and a cross-sectional end view (right figure) of a Roots-type positive-displacement compressor with a shunt pulsation trap according to a second alternative embodiment of the invention, showing multiple (per side of the trap chamber) non-flat perforated dampeners.

FIG. 5*b* shows a PD machine with a shunt pulsation trap according to a second example embodiment of the invention. In this embodiment, instead of a single perforated-tube dampening device per cavity, multiple such perforated-tube dampening devices 53 are used, such as the depicted array of paired (open end to open end) perforated-tubes axially aligned and mounted at two opposing and aligned transition ports on opposing sides of the casing of the transition chamber 55. One advantage of this embodiment results from the symmetrical arrangement of the pairs of perforated tubes 53 that are positioned 180 degrees apart and have an approximately equal distance from trap inlet 41 so that any unbalanced exciting forces on each perforated tube can be further canceled out. Moreover, such balanced perforated tube dampener 53 pairs can be mounted on the transitional chamber 55 as add-on modules, at least one pair or multiple pairs in parallel could be used.

Figure 6A:
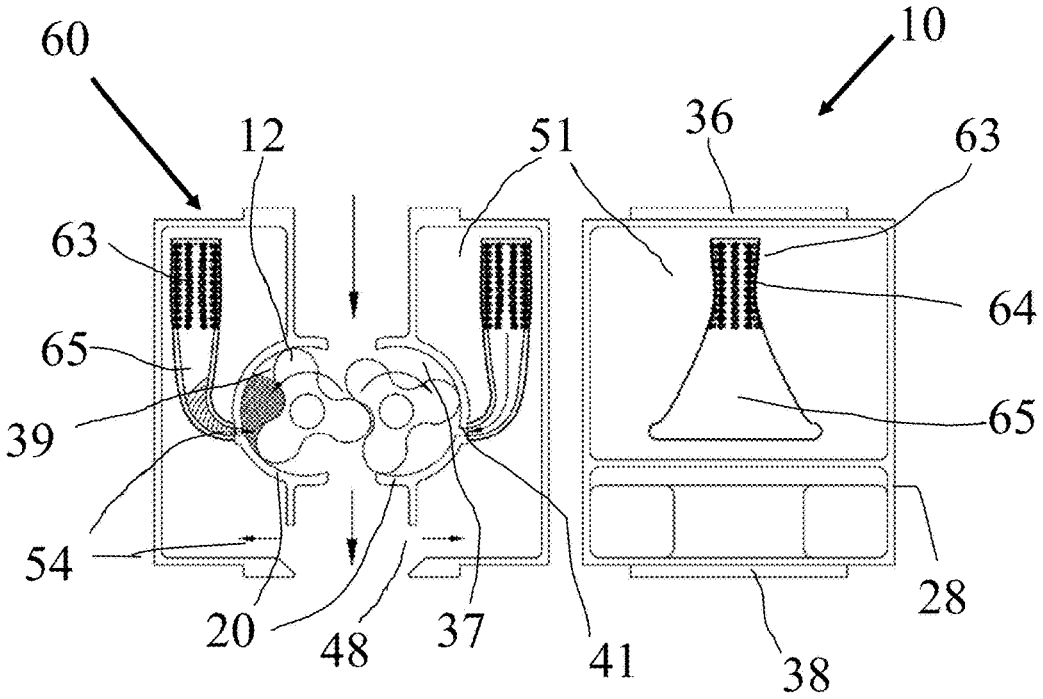
FIG. 6*a* is a cross-sectional side view (left figure) and a cross-sectional end view (right figure) of a Roots-type positive-displacement compressor with a shunt pulsation trap according to a third alternative embodiment of the invention, showing a single (per side of the trap chamber) "vacuum head" shaped non-flat perforated dampener.

FIG. 6*a* shows a positive displacement Roots type compressor 10 with a shunt pulsation trap apparatus 60 according to a third example embodiment of the invention. In this embodiment, a "vacuum head" shaped dampening device 63 is included (as compared with the perforated tube dampening device 53 and transitional chamber 55 in FIG. 5*a*) and mounted in communication with the trap inlet 41. The "vacuum head" shaped dampening device 63 reduces the secondary vibration and noise effect by incorporating a perforated tube section 64 and a continuous solid-wall transitional section 65 extending between the trap inlet 41 and the perforated tube section 64 so that the non-holed exciting surface area of the solid-wall transitional section 65 is minimized for each dampener 63. As shown in FIG. 6*a*, the EW and induced pulsation component IFF 54 originated from the trap inlet 41 will be confined to the streamlined "vacuum head" transition section 65 without much reflection during the transition and have the shortest distance to reach the perforated dampening section 64 of the dampening device 63 where their energy is turned into balanced flow distributed evenly on the cylindrical surface (of the perforated dampening section 64 of the dampening device 63) before its effect reaches downstream causing vibrations and noises. Moreover, the "vacuum head" shaped dampening device 63 can be made as a add-on module, at least one or multiple, single or back-to-back paired, configured in parallel. And the perforated section 64 and the solid-wall section 65 can be integrally formed as a single part (as depicted) or they can be separated formed and assembled together. The vacuum head dampener 63 can have a cylindrical perforated section 63 with the solid-wall transition section 64 transitioning to a slotted open end (for attachment at the slotted inlet port 41 of the trap chamber 51) and including a bend (e.g., angled about 90 degrees) as depicted, or it can be provided in other conventional shapes. The solid-wall transition section 64 provides the same functionality as the transition chamber of the embodiments of FIGS. 5*a* and 5*b*.

Figure 6B:
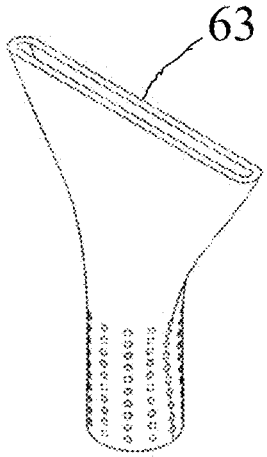
FIGS. 6*b* and 6*c* are perspective views of two different alternative embodiments of the "vacuum head" shaped perforated dampener of FIG. 6*a*.
Figure 6C:
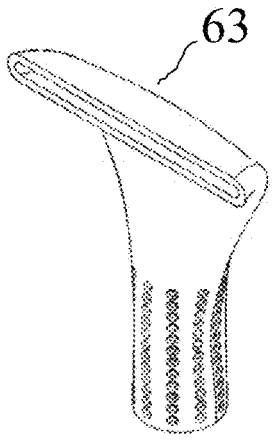

FIGS. 6*b* and 6*c* show two alternative embodiments of the "vacuum head" shaped perforated-tube dampener 63. In the perforated-tube dampener 63 of FIG. 6*b*, the perforated section and the transition section are axially aligned (instead of being angled). And the perforated-tube dampener 63 of FIG. 6*c* is similar to that of FIG. 6*a*.

Figure 7A:
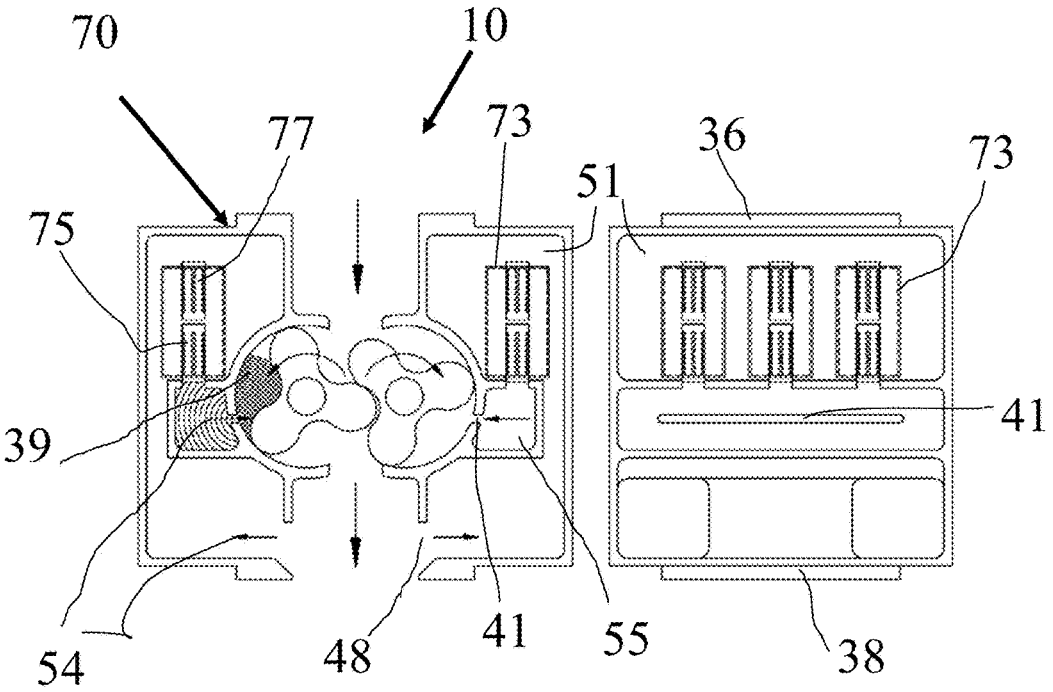
FIG. 7*a* is a cross-sectional side view (left figure) and a cross-sectional end view (right figure) of a Roots-type positive-displacement compressor with a shunt pulsation trap according to a fourth alternative embodiment of the invention, showing a two-staged non-flat perforated dampener in series.
Figure 7B:
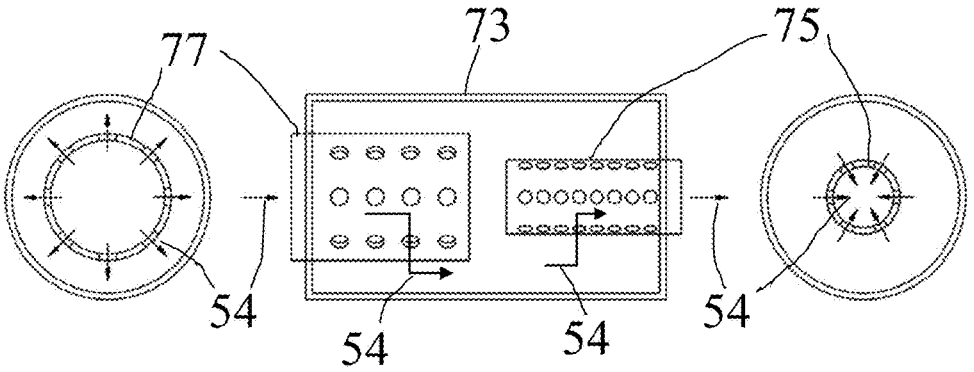
FIG. 7*b* is a side view and both corresponding end views of an alternative embodiment of the two-stage dampener arrangement of FIG. 7*a*.
Figure 7C:
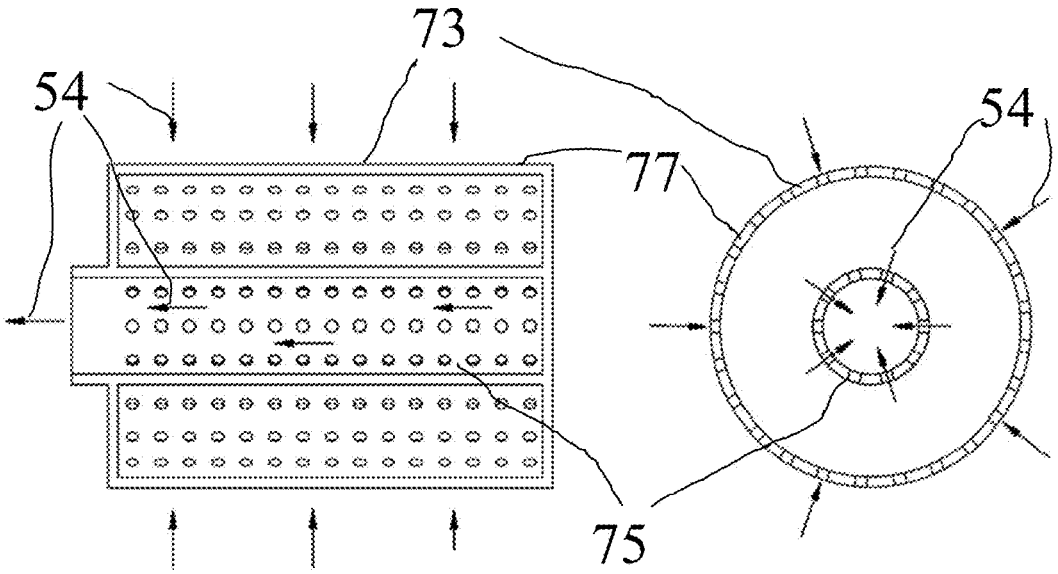
FIG. 7*c* is a side view and a corresponding end view of another alternative embodiment of the two-stage dampener arrangement of FIG. 7*a*.

FIG. 7*a* shows a positive displacement Roots type compressor 10 with a shunt pulsation trap apparatus 70 according to a fourth example embodiment of the invention. Instead of a single stage of a dampening device 53 or 63 as shown in FIGS. 5*a*-6*a*, multiple dampening devices 73 are used in series. In this embodiment, the EW and induced pulsation component IFF 54 originated from the trap inlet 41 will be attenuated first by the first stage 75 and further attenuated by the second stage 77 before its effect reaches downstream causing vibrations and noises, thus achieving more reductions in pulsation and noise. The dampener stages 75 and 77 can be mounted within a dampening chamber 73 formed by a dampening casing having first and second ports, with each port in communication with one of the dampener stages, and with one of the ports in communication with the trap inlet port 41. The dampener stages can be provided by any of the dampening devices described herein or others known in the art, for example the depicted perforated tubes 75 and 77. The dampener stages 75 and 77 can be arranged inline one after the other (axially aligned and spaced apart) as shown in FIG. 7*b*, or concentrically one inside the other (coaxially) as shown in FIG. 7*c*, and with different sizes and perforation configurations (size, shape, and pattern). In FIG. 7*b* (see also FIG. 7*a*), the route for the feedback flow (IFF) 54 (as indicated by the small arrows) is from the feedback port (trap outlet) 48 into the pulsation trap chamber 51, axially into the second stage dampener 77, radially outward into the dampening chamber 73, axially within the dampening chamber, radially inward into the first stage dampener 75, axially into the transitional chamber 55, and then converging to the injection port (trap inlet) 41 for releasing into the compression region 39 of the transfer chamber 37. In FIG. 7*c* (see also FIG. 7*a*), the route for feedback flow (IFF) 54 (as indicated by the small arrows) is from the feedback port (trap outlet) 48 into the pulsation trap chamber 51, radially inward into the second stage dampener 77, further radially inward into the first stage 75 dampener, axially into the transitional chamber 55, and then converging to the injection port (trap inlet) 41 and releasing into the compression region 39 of the transfer chamber 37 (in this embodiment, the perforated cylindrical outer wall of the coaxially-outermost second stage dampener 77 defines the dampening chamber 73). In typical embodiments such as that depicted, the dampeners 75 and 77 are both positioned within the dampening chamber 73, with the dampening chamber and the transitional chamber 55 connected in series and both positioned within the trap chamber 51. In other embodiments, the transition chamber is aligned with and serially connected to but not enclosed within the trap chamber, the dampening chamber enclosed within the transition trap chamber, the multi-stage dampeners are provided in dedicated respective dampening chambers serially connected together, and/or a first or second stage dampener and dampening chamber (and/or a transitional chamber) are connected to the trap feedback port (instead of to the trap inlet port).

Figure 8:
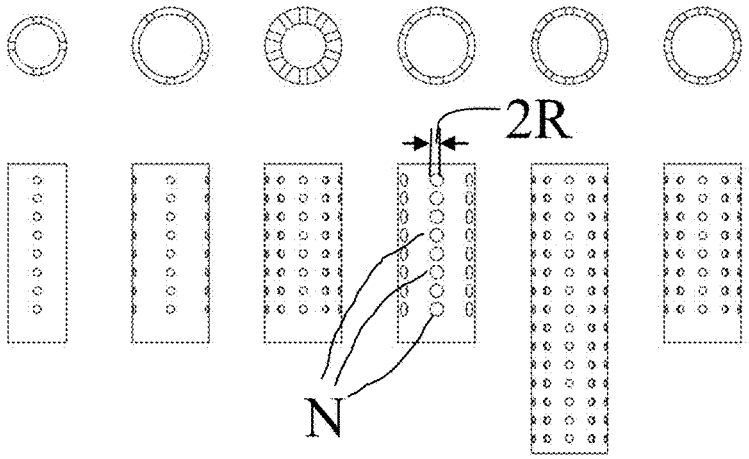
FIG. 8 is side views and corresponding end views of a series of alternative embodiments of the non-flat perforated dampeners of FIG. 5*a*-7*c*, showing different hole distribution patterns, sizes, and shapes.

FIG. 8 shows alternative embodiments of non-flat perforated dampeners for use in the pulsation traps 50, 60, 70 of the above-described embodiments, showing different hole distribution patterns and sizes. In principle, an area ratio of total internal surface area ($\pi DL$ where D and L are the diameter and length a cylinder/tube, see FIG. 5*a*) to perforation area (total hole area=$N\pi R^2$ where R is radius of hole and N is number of holes) at least larger than 5 to 1 is generally preferably provided in order to trap pulsations. On the other hand, total perforation area should be larger or close to the trap inlet area. For the same total perforation area, many smaller holes are generally preferred over few larger holes which should never be less than ten (10) per cylinder. Moreover, the distribution of holes on a cylindrical surface should generally preferably be arranged symmetrically about the cylindrical axis (so each hole has a cooperating radially opposite hole). An exception can be optional holes on the top endwall of the tube that can be included to stabilize induced flow. The shape of the holes can be of a constant cross-sectional area (cylindrical orifice), converging (nozzle), or a converging-diverging (De Laval nozzle) in the feedback flow direction.

Figure 9:
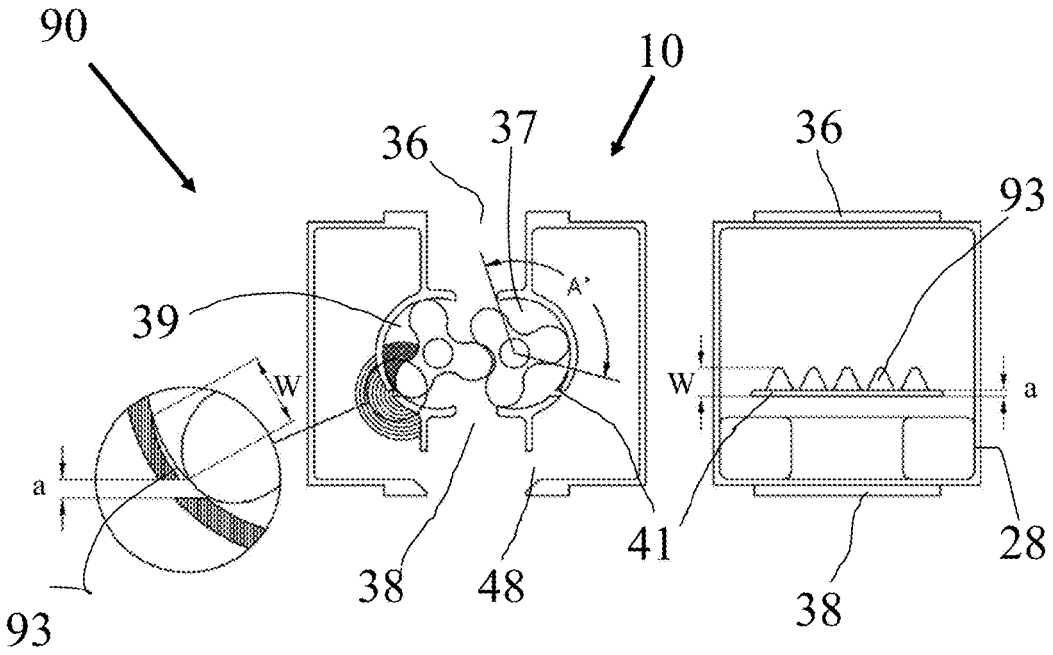
FIG. 9 is a cross-sectional side view (left figure) and a cross-sectional end view (right figure) of a Roots-type positive-displacement compressor with a shunt pulsation trap according to a fifth alternative embodiment of the invention, showing a micro pre-opening at the trap inlet as the dampener.

FIG. 9 shows a positive displacement Roots compressor 10 with a shunt pulsation trap apparatus 90 according to a fifth example embodiment of the invention. In this embodiment, at least one micro pre-opening 93 in the inner casing 20 is positioned adjacent and preceding (with respect to the rotor direction) the shunt pulsation trap inlet 41 as an alternative design of the pulsation dampening device 90. That is, the pulsation dampening device 90 is provided by the pre-opening 93, and as such no trap casing/chamber and interference-type dampener is provided, though in some embodiments both designs of pulsation dampening devices can be provided (this design in combination with one of the other designs described herein). In the depicted embodiment, a series of micro pre-openings 93 is provided, each in communication with the trap inlet 41. The micro pre-openings 93 are recessed into the inner surface of the inner casing 20 so that as the rotor tip passes over the recess a relatively smaller and increasingly larger flow passageway is opened to the trap inlet 41 before the rotor passes and opens the relatively larger trap inlet. The micro pre-openings 93 can have a shape forming a larger spaced flow passageway in the direction of the rotor travel, for example a wedge-shaped down ramp (at an angle relative to the inner surface of the inner casing 20) with the wide end at the trap inlet (as depicted), wedge-shaped but not ramped, ramped but not wedge-shaped, semi-circular (ramped or not), rectangular (with a ramped bottom surface), a combination thereof, or other configurations know to persons of skill in the art. Compared with a straight rectangular or cylindrical shunt pulsation trap inlet (injection port) 41 with various cross sectional profiles such as orifice, flow nozzle, or De Laval nozzle profile as shown in FIG. 4*b* (right), the micro pre-opening 93 with width W gradually opens the compression region 39 of the transfer chamber 37 to the trap inlet 41 (as each lobe tip of the respective rotor 12 approaches and passes it) with width "a" that is typically smaller than W. This way, the strength of induced EW & CW waves and IFF generated at the gradual pre-opening is less than a sudden pre-opening according to the shock tube theory. However, W cannot be too large due to the minimum length (shown as A)

of sealing requirement be at least one lobe span away (or one complete compression region 39 away) from the suction port 36 opening. For a 3-lobe Roots compressor, A is 120 degrees, for a 4-lobe Roots compressor, A is 90 degrees. Too large a W value would reduce the distance between the trap inlet 41 and the discharge port 48. In principle, the ratio of W/a should NOT be larger than 5 for a 3- or 4-lobe Roots compressor.

It is apparent from the preceding detailed description and summary in conjunction with the appended drawings that there has been provided in accordance with the present invention a shunt pulsation trap for a positive displacement (PD) gas machinery for effectively reducing gas pulsation and induced NVH, and improving system efficiency by eliminating a traditional serial pulsation dampener and/or a variable geometry. While the present invention has been described in the context of several specific embodiments, other alternatives, modifications, and variations will become apparent to those skilled in the art having read the foregoing description and the appended drawings. Accordingly, the present invention is intended to encompass those alternatives, modifications, and variations as fall within the broad scope of the appended claims.

What is claimed is:

1. A positive-displacement gas-transfer machine, comprising:

a. a housing structure defining a flow suction port, a flow discharge port, and a transfer chamber extending therebetween;

b. at least one positive-displacement drive device movably mounted within the transfer chamber and driven in a compression phase to reduce a volume of the compression region of the transfer chamber to propel fluid flow from the suction port to the discharge port of the transfer chamber; and c. a shunt pulsation trap apparatus including a trap chamber, at least one pulsation dampener positioned within the trap chamber, at least one trap inlet branching off from the compression region of the transfer chamber into the trap chamber, and at least one trap outlet communicating with the transfer chamber discharge port;

d. wherein in operation the positive-displacement gas-transfer machine achieves gas pulsation and induced NVH reduction and improves off-design efficiency.

2. The positive-displacement machine as claimed in claim 1, wherein a start of a gradual pre-opening of the compression region of the transfer chamber to the trap inlet is positioned at a distance at least one the transfer chamber away from the suction port or to be at least totally sealed or isolated by the positive-displacement drive device from the suction port and the gradual pre-opening of the compression region of the transfer chamber is located before the discharge port.

3. The positive-displacement machine as claimed in claim 2, wherein the ratio of the distance "W" between the start of the gradual pre-opening to the start of the trap inlet to the width "a" of the trap inlet is at least less than 5 to 1.

4. The positive-displacement machine as claimed in claim 1, wherein the at least one pulsation dampener includes at least one non-flat perforated device per trap/transfer chamber.

5. The positive-displacement machine as claimed in claim 4, wherein the non-flat perforated device is vacuum-head-shaped with a continuous transition from a generally rectangular shape at the trap inlet to a tubular cross-sectional shape.

6. The positive-displacement machine as claimed in claim 4, wherein the non-flat perforated device has a cylindrical shape with a constant cross-sectional area.

7. The positive-displacement machine as claimed in claim 6, wherein the cylindrical perforated device has a length-to-diameter ratio of at least or larger than 2 to 1.

8. The positive-displacement machine as claimed in claim 4, wherein the non-flat perforated device has a curved end section without any perforations.

9. The positive-displacement machine as claimed in claim 4, wherein the non-flat perforated device has an area ratio of total internal surface area to total perforation area of at least or larger than 5 to 1.

10. The positive-displacement machine as claimed in claim 4, wherein the non-flat perforated device has an area ratio of total perforation area to trap inlet area of at least or larger than 1.

11. The positive-displacement machine as claimed in claim 4, wherein the perforations of the non-flat perforated device have a shape of constant cross-sectional area, converging cross-sectional area, or a converging-diverging cross-sectional area in a feedback flow direction.

12. The positive-displacement machine as claimed in claim 4, wherein the non-flat perforated device has at least 10 perforations.

13. The positive-displacement machine as claimed in claim 4, wherein the perforations are arranged on the non-flat perforated device surface symmetrically about an axis of the device so that they are opposite to each other.

14. The positive-displacement machine as claimed in claim 4, wherein the perforations include sidewall perforations arranged on the non-flat perforated device surface symmetrically about an axis of the device so that they are opposite to each other and include at least one endwall center perforation aligned with the symmetrical axis.

15. The positive-displacement machine as claimed in claim 4, wherein the non-flat perforated device comprises at least two non-flat perforated devices arranged in parallel.

16. The positive-displacement machine as claimed in claim 4, wherein the non-flat perforated device comprises at least two non-flat perforated devices arranged in parallel and in axial alignment.

17. The positive-displacement machine as claimed in claim 4, wherein the non-flat perforated device comprises at least two non-flat perforated devices arranged in parallel with an area ratio of total perforation area to trap inlet area within 0.4-4.

18. The positive-displacement machine as claimed in claim 4, wherein the non-flat perforated device comprises at least two non-flat perforated devices arranged in series.

19. The positive-displacement machine as claimed in claim 4, wherein the non-flat perforated device comprises at least one pair of two non-flat perforated devices arranged in series and an axial alignment.

20. The positive-displacement machine as claimed in claim 4, wherein the non-flat perforated device comprises at least two non-flat perforated devices arranged in series with one positioned inside the other.

21. The positive-displacement machine as claimed in claim 4, wherein the non-flat perforated device comprises at least two non-flat perforated devices arranged in series with one positioned after the other.

* * * * *